United States Patent [19]

Sugiyama et al.

[11] 4,336,780

[45] Jun. 29, 1982

[54] JET CONTROL CARBURETOR

[75] Inventors: Katsuhiko Sugiyama, Aichi; Katsuyuki Ohsawa, Nagoya; Kenji Fujikake, Nagoya; Yoshinori Idota, Nagoya, all of Japan

[73] Assignee: Kabushiki Kasiha Toyota Chuo Kenkyusho, Nagoya, Japan

[21] Appl. No.: 149,626

[22] Filed: May 13, 1980

[30] Foreign Application Priority Data

| | | | |
|---|---|---|---|
| May 21, 1979 | [JP] | Japan | 54-62869 |
| Sep. 10, 1979 | [JP] | Japan | 54-115987 |
| Sep. 28, 1979 | [JP] | Japan | 54-126122 |
| Oct. 23, 1979 | [JP] | Japan | 54-136610 |
| Jan. 31, 1980 | [JP] | Japan | 55-10722 |

[51] Int. Cl.[3] ..... F02M 7/14

[52] U.S. Cl. ..... 123/438; 123/437; 123/440; 261/DIG. 39

[58] Field of Search ..... 123/437, 438, 440, 585, 123/589; 261/DIG. 39, DIG. 117, DIG. 40, DIG. 410, DIG. 78 R, DIG. 82

[56] References Cited

U.S. PATENT DOCUMENTS

| | | | |
|---|---|---|---|
| 2,541,316 | 2/1951 | Winkler | 261/DIG. 39 |
| 4,173,956 | 11/1979 | Ikeura et al. | 123/440 |
| 4,187,805 | 2/1980 | Abbey | 123/440 |

FOREIGN PATENT DOCUMENTS

| | | | |
|---|---|---|---|
| 2264982 | 10/1975 | France | 261/DIG. 39 |
| 52-53145 | 4/1977 | Japan | 261/DIG. 39 |
| 448307 | 5/1975 | U.S.S.R. | 123/437 |

*Primary Examiner*—Raymond A. Nelli

*Attorney, Agent, or Firm*—Oblon, Fisher, Spivak, McClelland & Maier

[57] ABSTRACT

A jet control type carburetor according to the present invention includes an intake pipe having an intake passage formed in an inner wall thereof, the intake passage allowing an intake air to flow therethrough; a venturi provided in the intake pipe, for controlling flow velocity and pressure of the intake air in the intake passage; a fuel nozzle opened into the intake passage and connected to a fuel supply source through a fuel passage for sucking the fuel within the intake passage from the fuel nozzle in order to introduce the mixture of air and fuel within the intake passage; a throttle valve provided downstream of the venturi, for controlling the flow rate of the mixture of intake air and fuel; a control air nozzle opened into the intake passage and connected to an air supply source through a control air passage for jetting the flow of the control air to the fuel spurted from the fuel nozzle to afford the kinetic energy of the control air to the fuel; and a throttle means provided upstream of the control air nozzle in the control air passage, for controlling the flow rate of the control air. The control air nozzle has a predetermined inner diameter ($d_a$) and is provided at a portion apart from the fuel nozzle with a predetermined spacing (W), and a dimensional relationship of the spacing W between the fuel nozzle and the control air nozzle to the inner diameter ($d_a$) of the control air nozzle is set as follows:

$$W/d_a \leqq 20.$$

31 Claims, 58 Drawing Figures

JET CONTROL CARBURETOR

BACKGROUND OF THE INVENTION

1. Field of the Invention

The present invention relates to a carburetor of the type, in which the air injected from an air nozzle is made to impinge upon the fuel spurting from a main nozzle so that the flow rate of the fuel from the main nozzle may be suppressed and controlled by the impinging force of the air from the air nozzle.

2. Description of the Prior Art

As the carburetor of the above type, we have already invented both a carburetor $C_1$, as is schematically shown in FIG. 1, and a carburetor $C_2$ which is slightly improved over the carburetor $C_1$ and has its improvement shown schematically in FIGS. 2A and 2B.

In these carburetors $C_1$, as shown in FIG. 1, the control air passage 18 has its inlet port 18*a* connected with an air filter A at a downstream position of the filter element thereof and its outlet port 18*b* within an intake passage. Between the inlet and outlet port 18*a*, 18*b*, there is disposed either a control valve 19, which is opened and closed by a control circuit 25 in response to the output of an oxygen sensor 24 made operative to detect the oxygen concentration in the exhaust gases of an engine E, or a flow regulating valve, which has its opening continuously or stepwise increased or decreased. An air nozzle 20 at the exit of the control air passage 18 is opened to protruded into a small venturi 3 of an intake pipe (intake passage) 1. The air nozzle 10 is provided to oppose to a main nozzle 10 at the exit of a main fuel passage 8 and the main fuel nozzle 10 is also opened to protrude into the small venturi, so that the two nozzles 10 and 20 are arranged at a position, where the air sucked from the air nozzle 20 is made to impinge upon the fuel sucked from the main nozzle 10. The impinging force of the air, which is injected from the air nozzle 20 for changing the flow rate of the fuel sucked from the main nozzle 10, is subjected to either an ON-OFF control by the control valve 19 as a throttle means or an analog or digital control by the flow regulating valve 19 thereby to control the air-fuel ratio of an intake mixture.

In the carburetor $C_2$ as shown in FIGS. 2A and 2B, on the other hand, either a dis-bar (distribution bar) 26 having such a semicircular cross-section as is fitted on the outer circumferences of the two nozzles 10 and 20, as shown in FIGS. 2A and 2B, or a dis-bar having another cross-section is disposed to extend at the inlet side of the small venturi 3 across the main nozzle 10 and the air nozzle 20, which protrude into the small venturi 3 in a manner to face each other, so that the air flow, which is injected from the air nozzle 20 to impinge upon the sucked fuel from the main nozzle 10, is prevented from being sharply deflected by the intake air flow passing through the small venturi 3 thereby to weaken the impinging force of the air injected from the air nozzle 80.

Although, in the carburetors $C_1$ and $C_2$ shown in FIGS. 1 and 2A and 2B, the air passage 18 has its air inlet disposed downstream of the air filter A, the present invention should not be limited to such construction but can be applied to the carburetor $C_1'$, as shown in FIG. 3, in which the air passage 18 has its air inlet opened into a separate compressed air source (CAS) while allowing others to have the same construction as the aforementioned one.

With this in mind, we have conducted systematic experiments and analyses with a view to enhancing the performance of the carburetor under consideration. These experiments and analyses have revealed that, in the carburetors $C_1$, $C_1'$ and $C_2$, the impinging force of the air flow injected from the air nozzle 20 can be adjusted to a desired strength by selecting the relative sizes, positions and angular relationship between the two nozzles 10 and 20 at a predetermined proper value and combining them. In the case of the most proper selection and combination thereof, the impinging force can be strengthen so the the range, within which the flow rate of the fuel to be sucked from the main nozzle 10 can be changed by that impinging force, and accordingly the range, within which the air-fuel ratio of the intake mixture can be controlled, can be widened.

With the use of such carburetors, moreover, the Inventors have conducted several series of experiments and analyses, while suitably selecting and combining the relative sizes, positions and angular relationship of the air nozzle and the main fuel nozzle, to find out the most proper sizes, positions and angular relationship that can make the impinging force of the air flow from the air nozzle the most proper thereby to widen the range, within which the flow rate of the fuel to be sucked from the main nozzle can be changed by that impinging force, and accordingly the range, within which the air-fuel ratio of the intake mixture can be controlled.

SUMMARY OF THE INVENTION

It is therefore an object of the present invention to provide such a jet control carburetor of the type, in which the air injected from an air nozzle is made to impinge upon the fuel spurting from a main nozzle so that the flow rate of the fuel from the main nozzle may be controlled by the impinging force of the air flow from the air nozzle, as is improved to prevent the impinging force of the air flow from the air nozzle from being weakened thereby to accurately control the air-fuel ratio of an intake mixture.

A primary object of the present invention is to provide a jet control carburetor in which the control air injected from the air nozzle has enough flow rate and flow velicity to obtain a desired impinging force, penetrates the flow of the intake air and reaches the flow of the fuel spurted from the fuel nozzle thereby accurately control the flow rate of the fuel and the air-fuel ratio of the intake mixture.

A further object of the present invention is to provide a jet control caburetor in which a dimensional relationship of a spacing (W) between the air and fuel nozzles and an inner diameter ($d_a$) of the air nozzle is selected to a predetermined proper range to obtain a desired impinging force.

A still further object of the present invention is to provide a jet control carburetor in which a dimensional relationship of an inner diameter ($d_a$) of the air nozzle and an inner diameter ($d_f$) of the main fuel nozzle is further selected to a predetermined proper range to obtain a desired impinging force in addition to the predetermined proper dimensional relationship of the spacing W and the inner diameter $d_a$ of the air nozzle.

Another object of the present invention is to provide a jet control carburetor in which a dimensional relationship of a length (x) of protrusion of the main fuel nozzle into the venturi and an inner diameter (d) of the venturi is further selected to a predetermined proper range to obtain a desired impinging force, in addition to the predetermined proper dimensional relationship of the spacing W and the inner diameter $d_a$ of the air nozzle, so that the desired stable and smooth combustion can be realized partly to enhance the driving performance and efficiency of an engine and partly to purify the engine exhaust gases.

Still another object of the present invention is to provide a jet control carburetor which can the most properly distribute and atomize the fuel thereby to provide excellent responsiveness and to exhibit markedly excellent effects in the drivability and in purifying the engine exhaust gases.

A further object of the present invention is to provide a jet control carburetor in which a horizontal angle ($\theta$) between the opening axis of the main fuel nozzle and the opening axis of the control fluid nozzle in the control fluid passage in view of the cross section of the intake passage and/or a vertical angle ($\alpha$) therebetween in view of the longitudinal section of the intake passage, are further selected to predetermined proper ranges, respectively in addition to the predetermined proper dimensional relationship of W and $d_a$.

A further object of the present invention is to provide a jet control carburetor which is made to vary the spacing W between the openings of the air and fuel nozzles by means of an air nozzle driving control device in accordance with the running condition of the engine.

In a carburetor of the type, in which the main nozzle of a main fuel passage and the air nozzle of a control air passage are made to protrude into the venturi in an air intake pipe and are arranged at a position, where the air injected from the air nozzle is made to impinge upon the fuel spurting from the main nozzle, so that the impinging force of the air flow from the air nozzle for changing the flow rate of the fuel from the main nozzle may be controlled to control the air-fuel ratio of an intake mixture, the jet control carburetor according to the present invention is constructed such that the spacing W between the air nozzle and the fuel nozzle is equal to or smaller than twenty times of the inner diameter $d_a$ of the air nozzle, ($W/d_a \leqq 20$).

For the various carburetors having the above construction, we have examined the ratio $V_O/V_S$ of the fuel flow rate $V_O$ in case there is an air flow from the air nozzle to the fuel flow rate $V_S$ in case there is no air flow against the ratio $W/d_a$ of the spacing W between the main nozzle and the air nozzle to the inner diameter $d_a$ of the air nozzle and have attained the results shown in FIG. 30.

From the results of FIG. 30, it has been confirmed that the ratio $V_O/V_S$ becomes not larger than 0.97 for the ratio $W/d_a$ equal to or smaller than 20 ($W/d_a \leqq 20$) and that there is a substantial change in the fuel flow rate in dependence upon whether or not there is an air flow rate from the air nozzle.

Thus, the jet control carburetor having the aforementioned construction ($W/d_a \leqq 20$) according to the present invention can enjoy a practical effect that the air injected from the air nozzle has its enough air flow rate and flow velocity to retain its impinging force and accordingly its penetrating ability into the main intake air thereby to accurately control the flow rate of the fuel spurting from the main nozzle by that impinging force and accordingly the air-fuel ratio of the intake mixture without receiving the influence of the intake flow. Thus, it is made possible to realize more precise control within a predetermined control range.

When the present invention is applied, it is possible to use atmospheric air or air under pressure as the control fluid to be injected from the air nozzle and to use not only a liquid fuel such as gasoline or light oil but also combustible gases such as propane gases as the fuel to be supplied from the main nozzle.

The jet control carburetor according to a first aspect of the present invention is constructed such that an inner diameter $d_a$ of the air nozzle is equal to or larger than one tenth of an inner diameter $d_f$ of the main fuel nozzle, (i.e., $d_a/d_f \geqq 0.1$) and that the spacing W between the two nozzles is equal to or smaller than twenty times of the inner diameter $d_a$ of the air nozzle, (i.e., $W/d_a \leqq 20$).

From the results of the several series of experiments conducted by the Inventors, the aforementioned ratio $V_O/V_S$ has been obtained and plotted, as shown in FIG. 29, against the ratio $d_a/d_f$ of the inner diameter $d_a$ of the air nozzle to the diameter $d_f$ of the main fuel nozzle. In order to expect the substantial control effects of the air-fuel ratio in a carburetor, the ratio $V_O/V_S$ has to be equal to or smaller than 0.97, (i.e., $V_O/V_S \leqq 0.97$). In order to realize this, therefore, it has been found sufficient that the ratio $W/d_a$ is equal to or smaller than 20 (i.e., $W/d_a \leqq 20$) and that the ratio $d_a/d_f$ is equal to or larger than 0.1, (i.e., $d_a/d_f \geqq 0.1$).

Since, in the carburetor according to the first aspect of the present invention, the inner diameter $d_a$ of the air nozzle is at least 10% of that $d_f$ of the main fuel nozzle, enough flow rate and flow velocity of the air injected from the air nozzle can be obtained to retain the desired strength of the impinging force of the air from the air nozzle and the penetrating ability into the main intake air thereof thereby to attain such a practical effect that the changeable range of the flow rate of the fuel spurting from the main fuel nozzle by that impinging force and accordingly the air-fuel ratio of the intake mixture can be accurately controlled.

If, on the contrary, the inner diameter $d_a$ of the air nozzle is smaller than 10% of that $d_f$ of the main fuel nozzle, the flow rate and velocity of the air to be injected from the air nozzle is so limited as to make it almost impossible to expect the effect of reducing the fuel flow rate.

On the other hand, another jet control carburetor according to a first example of the first aspect in the present invention is of the type, in which the air to be supplied to the air nozzle is substantially under an atmospheric pressure and is constructed such that the inner diameter $d_a$ of the air nozzle is at least 20% of that $d_f$ of the main fuel nozzle and that the spacing W between the two nozzles is at most ten times of the inner diameter $d_a$ of the air nozzle, (i.e., $d_a/d_f \geqq 0.2$ and $W/d_a \leqq 10$).

In the carburetor thus constructed according to the first example of the first aspect in the present invention, since the air to be injected from the air nozzle is substantially under the atmospheric pressure, as exemplified in the carburetor $C_1$ shown in FIG. 1, the momentum of the air injected from the air nozzle is not so large. In view of this, if the diameter $d_a$ of the air nozzle and the spacing W between the two nozzles are specified as in the above from the (later-described) results of a series of the experiments conducted by the Inventors, the flow rate and velocity of the air injected from the air nozzle is so sufficient, while suitably restricting the spacing W between the nozzles, that the penetrating ability to the intake air and impinging force of the air from the air nozzle can be retained at such a strength as to widen the changeable range of the flow rate of the fuel spurting from the main fuel nozzle by that impinging force and accordingly the controllable range of the air-fuel ratio of the intake mixture.

Next, still another jet control carburetor according to a second example of the first aspect in the present invention is of the type, in which the air to be supplied to the air nozzle is pressurized, and is constructed such that the inner diamter $d_a$ of the air nozzle is at least 17% of that $d_f$ of the main fuel nozzle and that the spacing W between the two nozzles is at most fifteen times of the inner diameter $d_a$ of the air nozzle, (i.e., $d_a/d_f \geqq 0.17$ and $W/d_a \leqq 15$).

The carburetor thus constructed according to the second example of the first aspect in the present invention can attain such a practical effect that the flow rate of the pressurized air injected from the air nozzle is so sufficient that the impinging force and penetrating ability of the air from the air nozzle can be retained at such a strength as to accurately control the flow rate of the fuel spurting from the main fuel nozzle by that impinging force and accordingly the air-fuel ratio of the intake mixture without receiving the influence of the intake flow.

Further, in this second example of the first aspect, since a pressure of the pressurized air source can be freely selected, the fuel flow rate can be sufficiently controlled by the control air flow even if the spacing W between the fuel and control air nozzles is wider than that in the case of the self suction type (the first example of the first aspect).

On the other hand, a jet control carburetor according to a second aspect of the present invention is constructed such that in addition to the definition of $W/d_a \leqq 20$, the length (x) of protrusion of the main fuel nozzle into the venturi is at least 30% and at most 80% of the inner diameter d of the venturi, (i.e., $0.3 \leqq x/d \leqq 0.8$).

In the carburetor thus constructed according to the second aspect of the present invention, the length x of protrusion of the main fuel nozzle into the venturi is so specified as in the above that the fuel injection port of the fuel nozzle is positioned at an almost equal distance apart from the opposed sides of the inner wall of the venturi. As a result, since the fuel spurting from the main fuel nozzle is always distributed widely and uniformly within the venturi, while being prevented from wetting the inner wall of the venturi, irrespective of the presence and strength of the impinging force of the air injected from the air nozzle, excellent fuel atomization can be attained to minimize the particle diameters of the fuel droplets so that the most proper mixture can be fed to the combustion chamber of the engine.

Thus, the carburetor according to the second aspect of the present invention can enjoy such a practical effect that the desired stable and smooth combustion can be realized partly to enhance the driving performance and efficiency of an engine and partly to purify the engine exhaust gases.

Another jet control carburetor according to the second aspect of the present invention is constructed such that the length x of protrusion of the main fuel nozzle into the venturi is selected at the best range and is at least 55% and at most 65% of the inner diameter d of the venturi, i.e., $0.55 \leqq x/d \leqq 0.65$.

The results of a series of experiments conduction by the Inventors have revealed that the fuel jet is carried apart from the main nozzle with its own injection velocity under the condition having no air jet injected from the air nozzle but is pushed close to the main fuel nozzle side by the impinging force of the air jet, under the condition having an air jet.

Therefore, if the dimensional relationship of x and d is within the aforementioned best range, the fuel jet reaches such an intermediate position between those under the conditions with or without the air jet that the fuel can be the most properly distributed and atomized.

Since, in this range the distribution and atomization of the fuel are effected under the best condition, the carburetor thus constructed can enjoy excellent responsiveness and exhibit markedly excellent effects in the drivability and in purifying the engine exhaust gases.

Next, the jet control carburetor according to a third aspect of the present invention is of the type, in which a venturi is disposed within an intake pipe for feeding intake air therethrough and in which a main fuel nozzle having communication with a fuel supply source is opened into that venturi so that a fuel is sucked out by the flow of the intake air, and is constructed such that at least one control fluid passage for injecting a control fluid toward the opening of the aforementioned main fuel nozzle is arranged to have its opening axis intersecting the opening axis of the main fuel nozzle, with a predetermined angles $\theta$ and/or $\alpha$. In the aforementioned control fluid passage there is disposed a control means, by which the flow rate of the control fluid flowing through the control fluid passage is controlled to control the flow rate of the fuel flowing from the aforementioned main fuel nozzle into the intake pipe thereby to control the mixing ratio between the intake air and the fuel. The horizontal angle relation of the opening axis of the main fuel nozzle and the opening axis of the control air nozzle is determined at an angle ($\theta$) in view of the cross section of the intake passage. While, the vertical angle relation of the opening axis of the main fuel nozzle and opening axis of the control air nozzle is determined at an angle ($\alpha$) in view of the longitudinal section of the intake passage.

The dimensional relationship (1) $-90$ degrees $\leqq \theta \leqq 90$ degrees and/or the dimensional relationship (2) $-90$ degrees $\leqq \alpha \leqq 90$ degrees are satisfied.

In the carburetor thus constructed according to the third aspect of the present invention, the control fluid flowing through its passage is injected from the control fluid nozzle to intersect the opening axis of the aforementioned main fuel nozzle toward the fuel to be injected from the main nozzle into the intake pipe, whereby the penetrating ability of the jet of the control fluid into the intake air to efficiently effect the direct impingement inbetween thereby to control the flow of the fuel so that the flow rate of the fuel can be finely and efficiently controlled. In other words, by injecting the control fluid to impinge upon the fuel, a kind of resistance is exerted upon the passage of the fuel so that the fuel flow rate can be controlled.

By the impingement of the control fluid, more specifically, the total pressure of the control fluid is applied in place of the static pressure of the intake air at the injection port of the fuel so that the difference in pressure between the fuel injection port and a float chamber is reduced to finely control the flow rate of the fuel. As a result, in the carburetor according to the third aspect of the present invention, the probability or possibility of the impingement of the control air flow upon the fuel can be increased by the aforementioned construction and angle relationship. Further the air-fuel ratio, the mixing condition and so on between the intake air and the fuel can be controlled excellently in stability and responsiveness, and the direct impingement of the control fluid upon the fuel can lead to remarkably fine and satisfactory mixing with the intake air thereby to facilitate the corelated control and to improve the reliability and durability while simplifying the construction of the carburetor itself.

Moreover, the jet control carburetor according to a fourth aspect of the present invention is constructed such that an air nozzle, which is connected with a control air passage and which is opened into the venturi of an intake pipe having the main fuel nozzle of a main fuel passage opened to protrude thereinto thereby to effect the impingement of the injected air upon the fuel injected from the main fuel nozzle, is made movable to vary the spacing W between the openings of the two nozzles, and such that there is provided an air nozzle driving control device for moving the air nozzle in accordance with the running condition of the engine.

In the carburetor thus constructed according to the fourth aspect of the present invention, it is possible to place the air nozzle at the most suitable position with respect to the fuel nozzle by varying the spacing W in accordance with the running condition of an engine. The air injected from the air nozzle is made to accurately impinge upon the fuel spurting from the main nozzle without receiving the influence of the intake flow, and the spacing W between the openings of the air and fuel nozzles is varied in accordance with the running condition of the engine. As a result, the flow rate of the fuel spurting from the main fuel nozzle is precisely controlled by the change in the impinging force of the air from the air nozzle.

Therefore, as is different from the prior art air bleed control carburetor, in which air is added to and mixed with the fuel flowing under its emulsion condition through the main fuel passage, no pulsation is established in the fuel sputing from the main fuel nozzle so that the flow rate of the fuel from the main fuel nozzle and accordingly the air-fuel ratio of the intake mixture can be accurately controlled.

Now, the carburetor according to the first example of the first aspect in the present invention thus far described may be further divided into the following modes.

The carburetor according to a first of the first example in the first aspect is constructed such that the diameter $d_a$ of the air nozzle is at least 20% of that $d_f$ of the main fuel nozzle and such that the spacing W between the air and fuel nozzles is at most twice of the diameter $d_a$ of the air nozzle, (i.e., $d_a/d_f \geqq 0.2$ and $W/d_a \leqq 2$).

In the carburetor thus constructed according to the first mode of the first example in the first aspect, since the air injected substantially under an atmospheric pressure from the air nozzle is introduced, it is liable to be influenced by the main intake air so that its penetration ability into the main intake air is possibly weakened. With this in mind, the aforementioned numerical ranges $d_a/d_f \geqq 0.2$ and $W/d_a \leqq 2$) is adopted to make the diameter $d_a$ of the air nozzle sufficiently large to the diameter $d_f$ of the fuel nozzle and the spacing W between the two nozzles relatively small so that the air jet is not weakened by the flow of the main intake air in the least.

As a result, the carburetor according to this first mode can attain such a practical effect that the flow rate of the injected air is retained not to deteriorate the strength of the impinging force and penetrating ability of the air flow into the main intake air thereby to widen the variable range of the flow rate of the fuel spurting from the main nozzle by that impinging force and accordingly the controllable range of the air-fuel ratio of the mixture.

On the other hand, another carburetor according to a second mode of the first example in the first aspect is constructed such that the diameter $d_a$ of the air nozzle is at least 20% and at most 120% of that $d_f$ of the main nozzle, (i.e., $W/d_a \leqq 2$ and $1.2 \geqq d_a/d_f \geqq 0.2$).

In the carburetor thus constructed according to this second mode, the flow rate of the air injected from the air nozzle is neither excessively low nor high so that all the air from the air nozzle can impinge upon the fuel flow thereby to effectively control the flow rate of the fuel.

Moreover, since the diameter $d_a$ of the air nozzle is almost of the same order as that $d_f$ of the main fuel nozzle, the flow rate of the air from the air nozzle can be reduced, and a control means disposed midway to the air nozzle for controlling the effective area of the passage can be sufficiently small.

A further carburetor according to a third mode of the first example in the first aspect is of the type, in which the main fuel nozzle of a main fuel passage and the air nozzle of a control air passage are made to protrude into the venturi in an intake pipe and are arranged at a position, where the air injected from the air nozzle is made to impinge upon the fuel spurting from the main fuel nozzle, and in which a dis-bar distribution bar) is disposed to extend at the inlet side of the venturi across the two nozzles so that the impinging force of the air spurting from the air nozzle for changing the flow rate of the fuel from the main fuel nozzle is controlled to control the air-fuel ratio of the intake mixture, and is constructed such that the diameter $d_a$ of the air nozzle is at least 20% of that $d_f$ of the main fuel nozzle and such that the spacing W between the two nozzles is at most ten times the diameter $d_a$ of the air nozzle, (i.e., $d_a/d_f \geqq 0.2$ and $W/d_a \leqq 10$).

In the carburetor thus constructed according to this third mode, since the dis-bar is disposed at the venturi inlet (or upstream) side of the main nozzle, the air jet from the air nozzle is injected into the separation region, which is formed in the wake of the dis-bar, so that it is not weakened by the flow of the main intake air. Even with the above-specified dimensional range, therefore, the impinging force of the air injected from the air nozzle is not so weakened as to enjoy substantially the same effects as have been described in the above so that the controllable range of the air-fuel ratio of the mixture can be widened.

A further carburetor according to a fourth mode of the first example in the first aspect is constructed such that the diameter $d_a$ of the air nozzle is at least 20% and at most 200% of that $d_f$ of the main nozzle and such that the spacing W between the air nozzle and the main nozzle is at most five times the diameter $d_a$ of the air nozzle, (i.e., $2.0 \geqq d_a/d_f \geqq 0.2$ and $W/d_a \leqq 5$).

In addition to the effects substantially similar to those described in the above, the carburetor thus constructed according to this fourth mode of the present invention can attain such a practical effect that the air flow injected from the air nozzle can be retained at the most proper rate to exert effective influences upon the fuel with a preset impinging force and with high penetrating ability into the main intake air thereby to widen the variable range of the fuel from the main nozzle by that impinging force and accordingly the controllable range of the air-fuel ratio of the mixture.

On the other hand, a further carburetor according to a fifth mode of the first example in the first aspect is constructed such that the diameter $d_a$ of the air nozzle is at least 20% and at most 200% of that $d_f$ of the main fuel nozzle, (i.e., $2.0 \geqq d_a/d_f \geqq 0.2$); such that the spacing W between the two nozzles is at most 200% of the diameter $d_a$ of the air nozzle, (i.e., $W/d_a \leqq 2$); such that the air nozzle is positioned at a portion apart from the main fuel nozzle by a predetermined distance $e_l$ along the axial direction of the venturi, the axial distance $e_l$ (or eccentricity $e_l$) apart from the center axis of the main fuel nozzle along the axial direction of the venturi being at most 250% of the diameter $d_a$ of the air nozzle toward the inlet side of the venturi and being at most 150% thereof toward the outlet side of the venturi, (i.e., $1.5 \leqq e_l/d_a \leqq 2.5$); and such that the air nozzle is positioned at a portion apart from the main fuel nozzle by a predetermined distance $e_r$ along the radial direction of the venturi, the predetermined radial distance $e_r$ (or eccentricity $e_r$) being at most 150% of the inner diameter $d_a$ of the air nozzle, (i.e., $e_r/d_a \leqq 1.5$).

In the carburetor thus constructed according to this fifth mode, since the air nozzle and the main nozzle are arranged at positions within the range as above described, the air injected from the air nozzle directly impinges upon the fuel, while substantially the same effects as have been described in the above being enjoyed, so that the controllable range of the air-fuel ratio of the intake mixture can be widened.

If, on the contrary, the shifting distances $e_l$ and radial eccentricities $e_r$ are larger than the aforementioned ranges, the air jet injected from the air nozzle does not directly impinge upon the fuel injected from the main nozzle so that the effects for reducing the fuel can hardly be expected.

A further carburetor according to a first mode of the second example of the first aspect in the present invention is of the type, in which the air pumped out of a pressurized air source is injected, and is constructed such that the diameter $d_a$ of the air nozzle is at most three times that of the main fuel nozzle and such that the spacing W between the two nozzles is at least 20% of and at most three times the diameter $d_a$ of the air nozzle, (i.e., $d_a/d_f \geqq 0.3$ and $0.2 \leqq W/d_a \leqq 3$).

In the carburetor thus constructed according this first mode of the second example in the first aspect, since pressurized air is used as the supply source of the control fluid for the carburetor, even if the diameter $d_a$ of the air nozzle and the spacing W between the two nozzles are set within the above-specified ranges, the impinging force of the air injected from the air nozzle can still have the controlling effect the flow rate of the fuel although it is slightly weakened by the flow of the main intake air.

As a result, the impinging force of the air from the air nozzle is not so weakened, while substantially the same effects as have been described in the above being retained, so that the variable range of the flow rate of the fuel spurting from the main nozzle by that impinging force and according the controllable range of the air-fuel ratio of the intake mixture can be widened.

A further carburetor according to a second mode of the second example in the first aspect is of the type, in which a main fuel nozzle connected with a fuel source and an air nozzle connected with a pressurized air source are made to protrude into the venturi in an intake air passage and are arranged at a position, where the air flow pumped out of the pressurized air source and injected from the air nozzle impinges upon the fuel flow sucked out of the main fuel nozzle by the vacuum in the venturi. In this carburetor, a dis-bar is disposed to extend at the inlet side of the venturi across the two nozzles so that the impinging force of the air injected from the air nozzle for varying the flow rate of the fuel from the main nozzle is contolled to control the air-fuel ratio of the intake mixture. The carburetor of this second mode is constructed such that the diameter $d_a$ of the air nozzle is at most three times that $d_f$ of the main nozzle and such that the spacing W between the two nozzles is at least 20% and at most seven and half times the diameter of the air nozzle, (i.e., $d_a/d_f \leqq 3$ and $0.2 \leqq W/d_a \leqq 7.5$).

In the carburetor thus constructed according to this second mode, since pressurized air is used as the supply source of the control air and since the dis-bar is disposed to extend at the inlet side of the venturi across the two nozzles, even if the diameter $d_a$ of the air nozzle and the spacing W between the two nozzles are set within the relatively wide ranges as abovespecified, the impinging force of the air injected from the air nozzle is not so weakened, while substantially the same effects as have been described in the above being retained, so that the controllable range of the air-fuel ratio of the intake mixture can be widened.

Finally, a further carburetor according to a third mode of the second example in the first aspect is of the type, in which the air pumped out of a pressurized air source is injected, and is constructed such that the diameter $d_a$ of the air nozzle is at least 17% of and at most three times that $d_f$ of the main fuel nozzle, (i.e., $0.17 \leqq d_a/d_f \leqq 3$); such that the spacing W between the two nozzles is at least 20% of and at most three times the diameter $d_a$ of the air nozzle, (i.e., $0.2 \leqq W/d_a \leqq 7.5$); and such that the air nozzle is positioned at a portion apart from the main fuel nozzle by a predetermined distance $e_l$ along the axial direction of the venturi, the axial distance $e_l$ (or eccentricity $e_l$) along the axial direction of the venturi being at most two and half times the diameter $d_a$ of the air nozzle toward the inlet side of the venturi and being at most 150% of the diameter $d_a$ of the air nozzle toward the outlet side of the venturi, (i.e., $1.5 \leqq e_l/d_a \leqq 2.5$); and such that the air nozzle is positioned at a portion apart from the main fuel nozzle by a predetermined distance $e_r$ along the radial direction of the venturi, the radial distance $e_r$ (or eccentricity $e_r$) being at most 150% of the diameter $d_a$ of the air nozzle, (i.e., $e_r/d_a \leqq 1.5$).

In the carburetor according to this third mode, since the air injected from the air nozzle directly impinges upon the fuel, its impinging force can be efficiently used, while substantially the same effects as have been described in the above being retained, so that the controllable range of the air-fuel ratio of the mixture can be widened.

BRIEF DESCRIPTION OF THE DRAWINGS

Various other objects, features and attendant advantages of the present invention, will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

The present invention will now be described in more detail in connection with the respective embodiments thereof with reference to the accompanying drawings.

First and second preferred embodiments according to the first aspect of the present invention is directed to a carburetor of the type, in which the air injected from the air nozzle is made to impinge upon the fuel spurting from the main nozzle so that the flow rate of the fuel from the main nozzle may be controlled by the impinging force of the air from the air nozzle, and contemplates to prevent the impinging force of the air from the air nozzle from being weakened thereby to widen the controllable range of the air-fuel ratio of the mixture.

In order to attain the aforementioned contemplation, the Inventors have conducted a series of experiments while varying the diameter $d_a$ of the air nozzle, the spacing W between the two nozzles and the shifting distances and eccentricities of air nozzle with respect to the fuel nozzle.

EXPERIMENT 1

In this Experiment 1, the aforementioned carburetor $C_1$ having no dis-bar was employed. In this carburetor $C_1$, in case the two nozzles 10 and 20 were coaxially arranged with zero axial distance and eccentricity inbetween, in case the spacing W between the two nozzles 10 and 20 was set ten and five times and equal to the diameter $d_a$ of the air nozzle 20, and in case the diameter ratio $d_a/d_f$ of the inner diameter $d_a$ of the air nozzle 20 to the inner diameter $d_f$ of the main nozzle 20 was set at respective values, the flow rate $V_O$ of the fuel from the main nozzle 10 when the control valve 19 as a throttle means was opened and the flow rate $V_S$ of the fuel from the main nozzle 10 when the control valve 19 was closed were measured to determine the ratio $V_O/V_S$ of the former flow rate $V_O$ to the latter flow rate $V_S$. The case, in which the flow rate ratio $V_O/V_S$ takes a value close to 1.0 means that the impinging force of the air from the air nozzle 20 is so weak as to narrow the variable range of the flow rate of the fuel from the main fuel nozzle 10 and accordingly the controllable range of the air-fuel ratio of the intake mixture.

On the contrary, the case, in which the flow rate ratio $V_O/V_S$ takes a value close to 0 means that the impinging force of the air from the air nozzle 20 is so strong as to widen the variable range of the fuel from the main nozzle 10 and accordingly the controllable range of the air-fuel ratio of the intake mixture.

Figure 1:
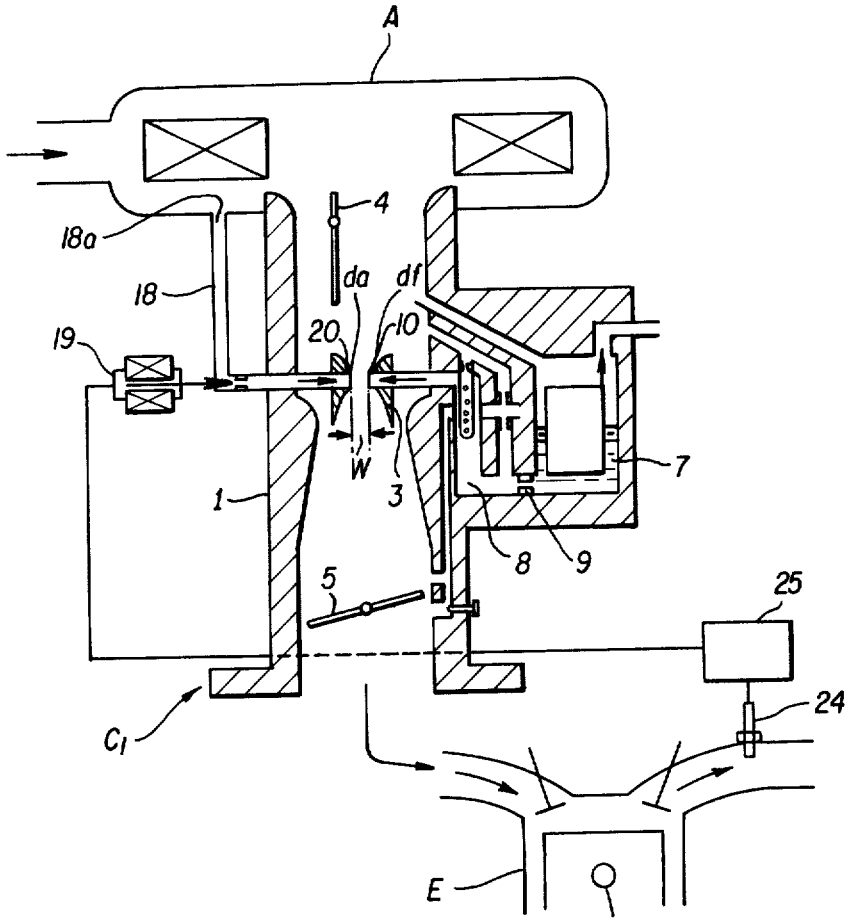
FIG. 1 PRIOR ART
FIG. 1 is a longitudinal section showing a carburetor according to the prior art.
Figure 2A:
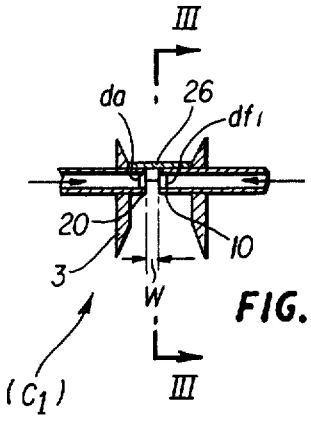
FIG. 2A PRIOR ART
FIGS. 2A and 2B are respectively a partially schematic view and a partially enlarged view showing another carburetor with dis-bar according to the prior art.
Figure 2B:
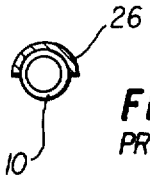
FIG. 2B PRIOR ART
Figure 3:
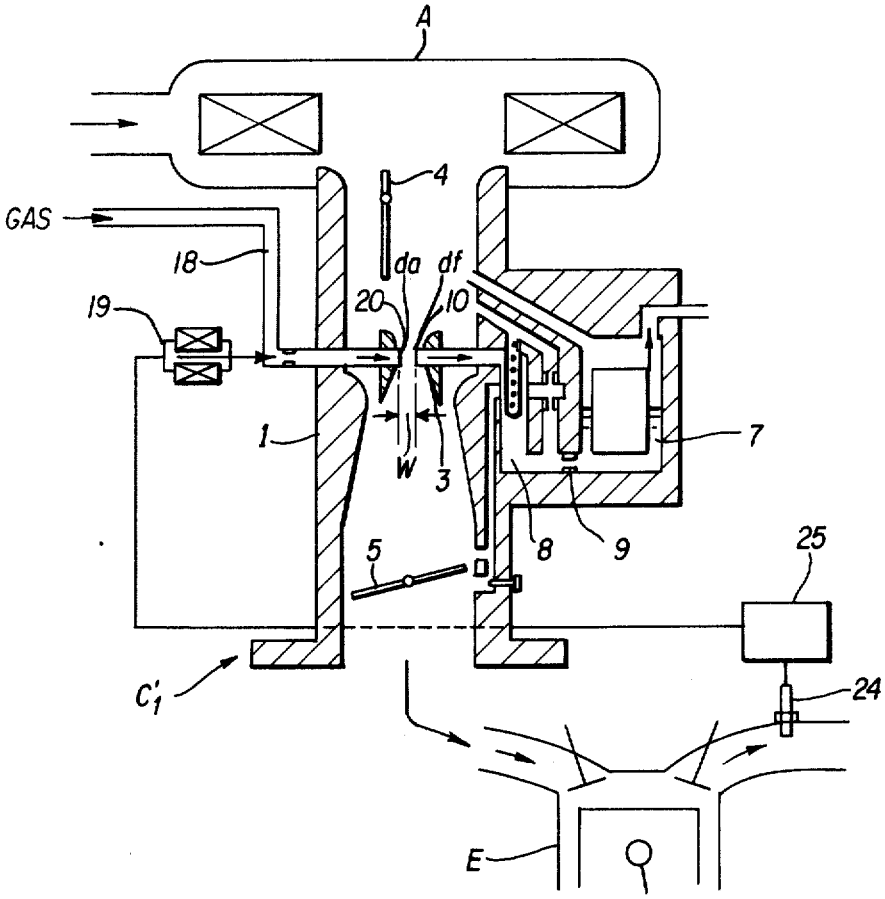
FIG. 3 PRIOR ART
FIG. 3 is a schematic view showing, a further carburetor in which compressed air is used as a control fluid according to the prior art.
Figure 4:
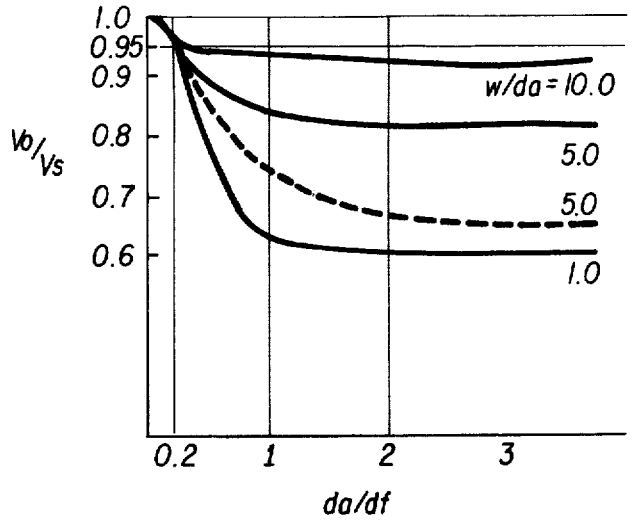
FIG. 4 is a graphical presentation showing the relationship between the flow rate ratio $V_O/V_S$ and the diameter ratio $d_a/d_f$ between the air and fuel nozzles.

The relationship between the flow rate ratio $V_O/V_S$ and the diameter ratio $d_a/d_f$ between the two nozzles obtained by the aforementioned experiments can be shown in solid curves in FIG. 4. In view of this graph, it is understood that, when the diameter $d_a$ of the air nozzle becomes so small that the diameter ratio $d_a/d_f$ becomes smaller than 0.2, the flow rate ratio $V_O/V_S$ of the fuel becomes larger than 0.95 to remarkably weaken the impinging force of the air from the air nozzle 20 thereby to remarkably narrow the controllable range of the air-fuel ratio of the intake mixture.

Here, the reason why the ratio $V_O/V_S$ has to be smaller than 0.95 is that the controllable range of a normal carburetor is not always sufficient for the ratio $V_O/V_S$ smaller than 0.97 in view of the production error. Therefore, if the production error and the design difference are taken into consideration, the ratio $V_O/V_S$ has to be smaller than 0.95. As a result, the diameter ratio $d_a/d_f$ between the two nozzles is limited to a value larger than 0.2.

Here, if the inner diameter $d_a$ of the air nozzle is increased until the diameter ratio $d_a/d_f$ becomes larger than 2, the ratio of the air flow, which can impinge upon the fuel spurting from the main fuel nozzle 10, to the whole air flow injected from the air nozzle 20 is so decreased that considerable effects cannot be expected even if the diameter $d_a$ of the air nozzle is increased.

Still the worse, when the control valve 19 is closed, a portion of the fuel spurting from the main fuel nozzle 10 steals to reside in the air nozzle, and the fuel in the air nozzle 20 flow out due to some cause so that the air-fuel ratio may frequently fluctuate unexpectedly in high amplitudes.

As a result, if consideration is taken into a disadvantage in case the diameter $d_a$ of such air nozzle becomes larger than several times that $d_f$ of the main fuel nozzle, the diameter ratio $d_a/d_f$ between the two nozzles is preferably lower than 2. Moreover, the best result can be obtained in case the diameter ratio $d_a/d_f$ between the two nozzles is about 1.

EXPERIMENT 2

In this Experiment 2, the aforementioned carburetor $C_1$ having no dis-bar, was also employed. In this carburetor $C_1$, in case the two nozzles 10 and 20 were arranged coaxially, in case the diameter ratio $d_a/d_f$ between the two nozzles was set at 0.5, 1 or 3, and in case the ratio $W/d_a$ of the spacing W between the two nozzles to the diameter $d_a$ of the air nozzle was set at respective values, the ratios $V_O/V_S$ of the flow rate $V_O$ of the fuel from the main fuel nozzle 10 when the control valve 19 as a throttle means was opened to the flow rate $V_S$ of the fuel from the main fuel nozzle 10 when the control valve 19 was closed were obtained. The relationship between the flow rate ratio $V_O/V_S$ and the ratio of the spacing W between the two nozzles to the inner diameter $d_a$ of the air nozzle is solid curves in FIG. 5.

In view of this graph, it is clearly found that, when the spacing W between the two nozzles is so increased that its ratio $W/d_a$ to the inner diameter $d_a$ of the air nozzle becomes larger than 10, the flow rate ratio $V_O/V_S$ of the fuel becomes larger than 0.95 so that the impinging force of the air from the air nozzle 20 is so remarkably weakened as to accordingly narrow the controllable range of the air-fuel ratio of the intake mixture. As a result, the ratio $W/d_a$ of the spacing W between the two nozzles to the inner diameter $d_a$ of the air nozzle is limited to a value smaller than 10.

Figure 5:
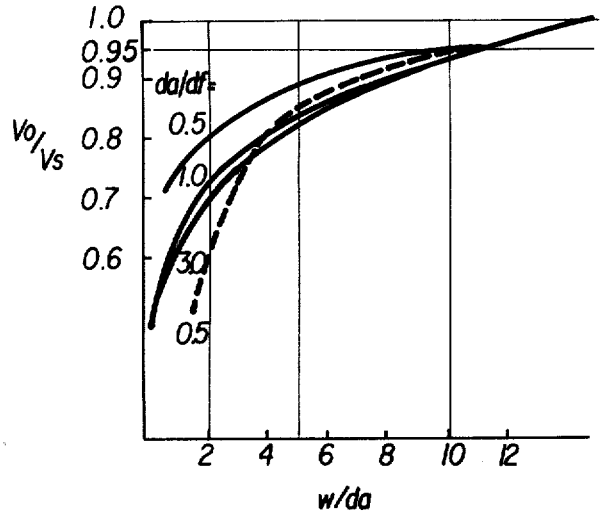
FIG. 5 is a graphical presentation showing the relationship between the flow rate ratio $V_O/V_S$ and the ratio $W/d_a$ of the spacing W between the air and fuel nozzles to the diameter $d_a$ of the air nozzle.

As is apparent from the solid curves of FIG. 5, moreover, the ratio $W/d_a$ of the spacing W between the two nozzles to the inner diameter $d_a$ of the air nozzle is preferably smaller than 2.

If, however, the spacing W between the two nozzles is so markedly narrowed that its ratio $W/d_a$ to the inner diameter $d_a$ of the air nozzle is accordingly reduced, the air nozzle 20 itself prevents the fuel from spurting from the main nozzle 10, when the control valve 19 is closed, so that the flow rate of the fuel from the main nozzle 10 is reduced.

On the other hand, since the flow rate ratio $V_O/V_S$ of the fuel from the main fuel nozzle 10 becomes very small, there arises a disadvantage that the fluctuations in the fuel flow when the control valve 19 is closed become excessively high. In order to eliminate this disadvantage, there is disposed between the air nozzle 20 of the control air passage 18 and the control valve 19 a throttle, by which the fluctuations in the air flow when the control valve 19 is closed are damped so that the fluctuations in the fuel flow may be damped by the damped fluctuations in the air flow. If consideration is taken into the aforementioned disadvantage in case the spacing W between the two nozzles is remarkably narrowed, the ratio $W/d_a$ of the spacing W between the two nozzles to the inner diameter $d_a$ of the air nozzle is preferably larger than 0.2 and smaller than 1.2 and the best at about 0.6.

EXPERIMENT 3

In Experiment 3, the aforementioned carburetor $C_2$ equipped with the dis-bar 26 was employed. In this carburetor $C_2$, in case the ratio $W/d_a$ of the spacing W between the two nozzles to the inner diameter $d_a$ of the air nozzle was set at 5, while making others similar to the case of Experiment 1 having no dis-bar, the relationship between the flow rate ratio $V_O/V_S$ of the fuel and the inner diameter ratio $d_a/d_f$ between the two nozzles was obtained, as shown in broken curve in FIG. 4. As is apparent from the graph of FIG. 4, even in case the dis-bar 26 is provided, the inner diameter ratio $d_a/d_f$ between the two nozzles is limited to a value higher than 0.2.

By the similar reason to the case of the Experiment 1 having no dis-bar, on the other hand, the inner diameter ratio $d_a/d_f$ between the two nozzles is preferably smaller than 2 and the best at about 1.

EXPERIMENT 4

In Experiment 4, the aforementioned carburetor $C_2$ equipped with the dis-bar 26 was also employed. In this carburetor $C_2$, in case the diameter ratio $d_a/d_f$ between the two nozzles was set at 0.5, while making others similar to the case of the Experiment 2 having no dis-bar, the relationship between the flow rate ratio $V_O/V_S$ of the fuel and the ratio $W/d_a$ of the spacing W between the two nozzles to the inner diameter $d_a$ of the air nozzle was obtained, as shown in a broken line in FIG. 5. As is apparent from the broken curve of the graph in FIG. 5, even in case the dis-bar 26 is provided, the ratio $W/d_a$ of the spacing W between the two nozzles to the inner diameter $d_a$ of the air nozzle is limited to a value smaller than 10.

As is also apparent from the broken curve of the graph in FIG. 5, the ratio $W/d_a$ of the spacing W between the two nozzles to the inner diameter $d_a$ of the air nozzle is preferably smaller than 5.

If, however, the ratio $W/d_a$ of the spacing W between the two nozzles to the inner diameter $d_a$ of the air nozzle becomes remarkably small, there arises a similar disadvantages to the case of the Experiment 2 having no dis-bar. Thus, that ratio $W/d_a$ is preferable not to be remarkably small and the best about 1.5.

EXPERIMENT 5

Figure 6:
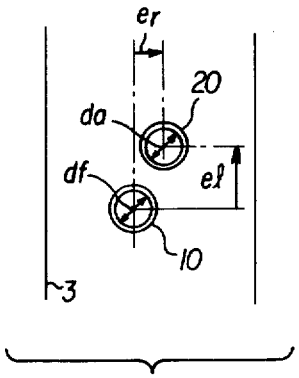
FIG. 6 is a schematic view showing the conditions of a predetermined distance $e_l$ of the air nozzle to the fuel nozzle along the axial direction of the venturi and of a predetermined distance $e_r$ thereof to the fuel nozzle along the radial direction of the venturi in a carburetor used in Experiment 5 for the first and second embodiments of the present invention.

In Experiment 5, the aforementioned carburetor $C_1$ having no dis-bar, was employed. In this carburetor $C_1$, in case the diameter ratio $d_a/d_f$ between the two nozzles was set at 1, in case the ratio $W/d_a$ of the spacing W between the two nozzles to the inner diameter $d_a$ of the air nozzle was set at 1, in case the predetermined distance $e_r$ (or the eccentricity $e_r$) of the air nozzle 20 shown in FIG. 6 along the radial direction of the small venturi 3 with respect to the main fuel nozzle 10 was set at zero, and in case the predetermined distance $e_l$ (or the eccentricity $e_l$) of the air nozzle 20 shown in FIG. 6 along the axial direction of the small venturi 3 with respect to the main nozzle 10 was set at various values for the inner diameter $d_a$ of the air nozzle, the ratio $V_O/V_S$ of the fuel flow rate $V_O$ form the main fuel nozzle 10 when the control valve 19 as a throttle means was opened to the fuel flow rate $V_S$ from the main fuel nozzle 10 when the control valve 19 was closed was obtained. Then, the relationship between the flow rate ratio $V_O/V_S$ and the ratio $e_l/d_a$ of axial distance $e_l$ (or the eccentricity $e_l$) of the air nozzle 20 along the axial direction of the small venturi 3 with respect to the inner diameter $d_a$ of the air nozzle is shown in FIG. 7.

Figure 7:
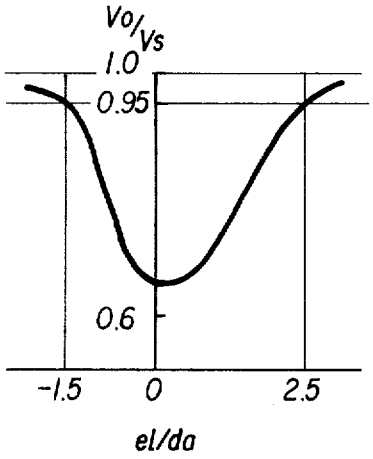
FIG. 7 is a graphical presentation showing the relationship between the flow rate ratio $V_O/V_S$ and the ratio $e_l/d_a$ of the shifting distance $e_l$ of the air nozzle along the axial direction of the venturi with respect to the diameter $d_a$ of the air nozzle.

As is apparent from the graph of FIG. 7, when the eccentricity $e_l$ of the air nozzle 20 toward the inlet side (the upstream side) of the small venturi 3 exceeds two and half times the inner diameter $d_a$ of the air nozzle or when the eccentricity $-e_l$ of the air nozzle 20 toward the outlet side (the downstream side) of the small venturi 3 exceeds one and half times the inner diameter $d_a$ of the air nozzle, the flow rate ratio $V_O/V_S$ of the fuel becomes larger than 0.95 so that the impinging force of the air injected from the air nozzle 20 is so weakened as to remarkably narrow the controllable range of the air-fuel ratio of the mixture.

As a result, the eccentricity $e_l$ of the air nozzle 20 to the inlet side of the small venturi 3 is limited to a value smaller than two and half times the diameter $d_a$ of the air nozzle.

On the other hand, the eccentricity $-e_l$ of the air nozzle 20 to the outlet side of the small venturi 3 is limited to a value smaller than one and half times the diameter $d_a$ of the air nozzle.

Incidentally, the reason why the allowable eccentricity of the air nozzle 20 to the inlet side of the small venturi 3 is larger than the allowable value of the air nozzle 20 to the outlet side of the small venturi 3 is based on the fact that the air flow injected from the air nozzle 20 is deflected toward the outlet side of the small venturi 3 by the action of the flow of the main intake air flowing from the inlet to the outlet of the small venturi 3.

On the other hand, the best result can be obtained in case the air nozzle 20 is not eccentric in the axial direction with respect to the main fuel nozzle 10, i.e., air and main fuel nozzles 20, 10 are in the same position on the center axis of the venturi.

EXPERIMENT 6

Figure 8:
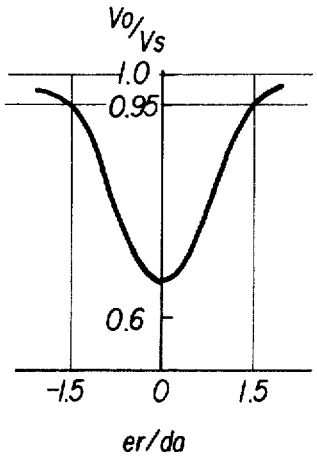
FIG. 8 is a graphical presentation showing the relationship between the flow rate ratio $V_O/V_S$ and the ratio $e_r/d_a$ of the eccentricity $e_r$ of the air nozzle in the radial direction of the venturi to the diameter $d_a$ of the air nozzle.

In Experiment 6, the aforementioned carburetor $C_1$ having no dis-bar, was also employed. In this carburetor $C_1$, in case both the diameter ratio $d_a/d_f$ between the two nozzles and the ratio $W/d_a$ of the spacing W between the two nozzles to the inner diameter $d_a$ of the air nozzle were set at 1, in case the axial distance $e_l$ (or the eccentricity $e_l$) of the air nozzle 20 along the axial direction of the small venturi 3 with respect to the main nozzle 20 was set at zero, and in case the radial distance $e_r$ (or the eccentricity $e_r$) of the air nozzle 20 along the radial direction of the small venturi 3 in view of the cross section thereof with respect to the main nozzle 10 was set at various values for the values of the inner diameter $d_a$ of the air nozzle, the flow rate ratios $V_O/V_S$ of the fuels spurting from the main nozzle 10 when the control valve 19 are opened and closed were obtained. The relationship between the flow rate ratios $V_O/V_S$ and the ratio $e_r/d_a$ of the eccentricity $e_r$ of the air nozzle 20 along the radial direction of the small venturi 3 in view of the cross section thereof to the inner diameter $d_a$ of the air nozzle is obtained, as shown in FIG. 8. As will be understood from the graph of FIG. 8, the eccentricities $e_r$ and $-e_r$ of the air nozzle 20 along the radial direction of the small venturi 3 with respect to the main nozzle 10 are limited to a value smaller than one and half times the inner diameter $d_a$ of the air nozzle.

It is apparent that the best result can be attained in case the air nozzle 20 is not eccentric along the radial direction of the small venturi 3 in view of the cross section thereof with respect to the main nozzle 10.

Figure 9:
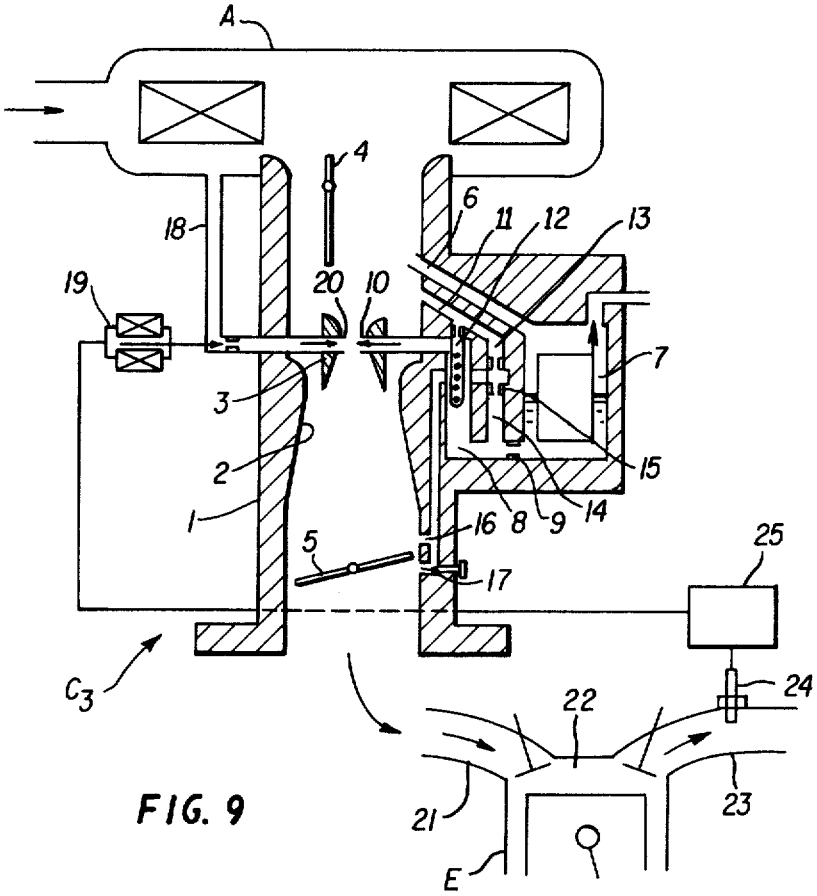
FIG. 9 is a longitudinal section showing the jet control type carburetor according to a first embodiment of the present invention.

A carburetor $C_3$ according to a first preferred embodiment belonging to the first example of the first aspect in the present invention is constructed, as shown schematically in FIG. 9.

The air cleaner of air filter A has its outlet connected with the upper end inlet of the intake pipe 1 whereas the engine E has its intake manifold 21 connected to the lower end outlet of the intake pipe 1. A main venturi 2 is formed at the center portion of the inner circumferential wall of the intake pipe 1. The small venturi 3 is provided to have its outlet opened into the throat of the main venturi 2. A choke valve 4 and a throttle valve 5 are disposed within the intake pipe 1, respectively, at a position above the small venturi 3 and at a position below the main venturi 2. There is disposed sideway of the intake pipe 1 a float chamber 7 which has communication with the upper end portion of the intake pipe 1 through an air vent tube 6. There is connected to the float chamber 7 the inlet of the main fuel passage 8, which is equipped with a main jet 9. There is connected to a midway portion of the main fuel passage 8 the main bleed tube 12 of a bleed air passage 11, which in turn is connected to the upper end portion of the intake pipe 1. The main fuel nozzle 10 having a circular cross-section, which is formed at the outlet of the main fuel passage 8, is opened to protrude into the throat of the small venturi 3. A jet 15 is disposed midway of the slow fuel passage 14 which is branched from a position just downstream of the jet 9 of the main fuel passage 8. A slow branch 13 of the bleed air passage 11 is connected to that jet 15. A slow port 16 and an idle port 17 constituting the outlet of the slow fuel passage 14 are opened into the inner circumferential wall of the intake pipe 1 in the vicinity of the throttle valve 5. There are provided a power fuel passage and an acceleration fuel passage, although not shown.

As is shown schematically in FIG. 9, moreover, the electromagnetic control valve 19 as a throttle means is disposed midway of the control air passage 18 which has its inlet connected with the air filter A downstream of the filter element thereof. The air nozzle 20 having a circular cross-section, which is formed at the outlet of the control air passage 18, opened to protrude into the throat of the small venturi 3 at a position to face the main nozzle 10. These two nozzles 10 and 20 are arranged in such a concentric manner as to set the eccentricity inbetween at zero. The two nozzles 10 and 20 have their inner diameters $d_a$ and $d_f$ set to have the same size and their spacing W set at 60% of the inner diameter $d_a$ of the air nozzle 20, (i.e., $d_a/d_f=1$ and $W/d_a=0.6$). The exhaust passage of the exhaust manifold 23 of the engine E is equipped with the oxygen sensor 24 which is operative to generate a voltage of such a level as corresponds to the oxygen concentration in the engine exhaust gases. The ON-OFF electronic control unit 25 is provided to open and close the electromagnetic control valve 19 in a preset frequency so that the open time of the control valve during one cycle is increased and decreased in accordance with the level of the output voltage of the oxygen sensor 24.

Moreover, an ON-OFF control system of closed loop is composed of the main nozzle 10, the intake pipe 1, the intake manifold 21 of the engine E, a combustion chamber 22, an exhaust manifold 23, the oxygen sensor 24, the ON-OFF electronic control unit 25, the electromagnetic control valve 19, the control air passage 18 and the air nozzle 20.

In the carburetor $C_3$ thus constructed according to the first embodiment, air is sucked through the air cleaner A into the intake pipe 1 by the drive of the engine E. Under a high speed running condition of the engine E with the throttle valve 5 being fully open, a fuel under an emulsion condition is sucked from the main fuel nozzle 10 by the vacuum pressure in the small venturi 3. This fuel thus sucked under the emulsion condition into the intake pipe 1 prepares a combustible mixture together with the intake air flowing through the intake pipe, and the resultant mixture is fed to the combustion chamber 22 of the engine E.

On the contrary, when the electromagnetic control valve 19 is opened, communication is established between the air cleaner A downstream of the filter element thereof and the air nozzle 20 so that the air is sucked out of the air nozzle 20 by the vacuum pressure in the small venturi 3. The air thus sucked from the air nozzle 20 then impinges upon the fuel sucked from the main fuel nozzle 10 to suppress the injecting force of the fuel from the main nozzle 10 so that the flow rate of the fuel to be injected from the main fuel nozzle 10 is reduced to inversely proportionately increase the air-fuel ratio of the intake mixture. Therefore, if the open time of one opening and closing cycle of the electromagnetic control valve 19 is elongated, the overall air-fuel ratio of the intake mixture is raised, whereas, if the aforementioned open time is shortened, the overall air-fuel ratio of the intake mixture is dropped.

As a result, in the carburetor $C_3$ according to the present first embodiment, the oxygen concentration in the exhaust gases of the engine E, which is detected by the oxygen sensor 24, is found higher than a reference value, i.e., if the air-fuel ratio of the intake mixture being fed to the engine E is higher than a proper value (the lean mixture condition), the electronic ON-OFF control unit 25 shortens the aforementioned open time of the electromagnetic control valve 19 so that the air-fuel ratio of the intake mixture is reduced until it reaches a proper value.

On the other hand, if the oxygen concentration in the exhaust gases if found lower than the reference value (the rich mixture condition), the electronic ON-OFF control unit 25 elongates the aforementioned open time of the electromagnetic control valve 19 so that the air-fuel ratio of the intake mixture is augmented until it reaches the proper value.

The carburetor $C_3$ according to the first embodiment is constructed such that the main nozzle 10 and the air nozzle 20 are so coaxially arranged as to have their eccentricity set at zero, such that the inner diameters $d_a$ and $d_f$ of the two nozzles 10 and 20 are set at the same size and such that the spacing W between the two nozzles 10 and 20 is set at 60% of the inner diameter $d_a$ of the air nossle, (i.e., $d_a/d_f=1$ and $W/d_a=0.6$).

As is apparent from the aforementioned Experiments 1, 2,5 and 6, therefore, the impinging force of the air injected from the air nozzle is not considerably weakened so that the variable range of the flow rate of the fuel spurting from the main nozzle by that impinging force and accordingly the controllable range of the air-fuel ratio of the mixture can be kept wide. Moreover, the carburetor $C_3$ can be free from the aforementioned disadvantage, which might otherwise be experienced in case the inner diameter $d_a$ of the air nozzle is larger than several times that $d_f$ of the main nozzle or in case the spacing W between the two nozzles is remarkably narrowed in comparison with the inner diameter $d_a$ of the air nozzle.

Figure 10:
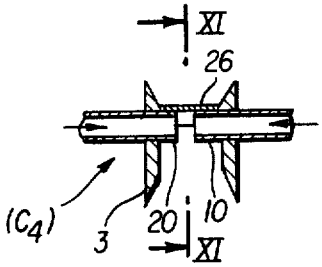
FIGS. 10 and 11 are respectively sectional views showing in an enlarged scale the jet control carburetor according to a second embodiment of the present invention.
Figure 11:
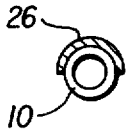

Next, in a carburetor $C_4$ according to a second embodiment of the present invention, which belongs to the first example of the first aspect, as shown partially and schematically in FIGS. 10 and 11, a dis-bar (distribution bar) 26 having a semicircular cross-section is arranged to extend at the inlet side of the small venturi across the main and air nozzles 10 and 20, which have the same diameter and which are coaxially arranged to protrude into the small venturi 3 in a manner to face each other, along the outer circumferences of the same. The spacing W between the two nozzles 10 and 20 is set at one and half times the inner diameter $d_a$ of the air nozzle ($W/d_a=1.5$). Incidentally, other portions are similar to those of the carburetor $C_3$ according to the preceding example, and their explanations are omitted here.

The carburetor $C_4$ according to the second embodiment is constructed such that the inner diameters $d_f$ and $d_a$ of the main nozzle 10 and the air nozzle 20, which are coaxially arranged, are made to have the same size, and such that the spacing W between the two nozzles 10 and 20 is set at one and half times the inner diameter $d_a$ of the air nozzle. As is apparent from the aforementioned Experiments 3 and 4, therefore, the impinging force of the air injected from the air nozzle is not markedly weakened so that the controllable range of the air-fuel ratio of the intake mixture can be kept wide.

The two carburetors $C_3$ and $C_4$ according to the first and second embodiments have been schematically shown in FIGS. 9 to 11 and described in the above and may be modified, as will be exemplified in the following.

(1) The opening of the main fuel nozzle 10 or the air nozzle 20 is formed into an oval, elongated circular or other shape. In the case of these non-circular openings, the diameter of a circle having the same opening area is assumed to represent the diameter of the main fuel nozzle or the air nozzle.

Figure 12:
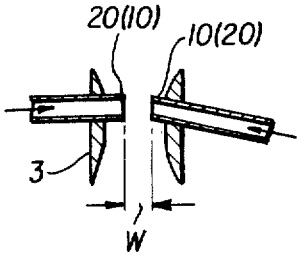
FIGS. 12 to 25 are schematic views showing modifications according to the first and second embodiments of the present invention.
Figure 13:
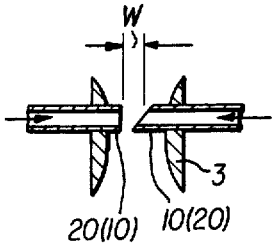
Figure 14:
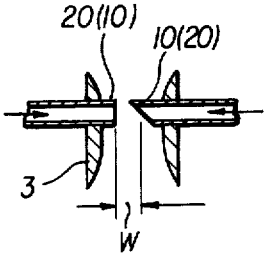
Figure 15:
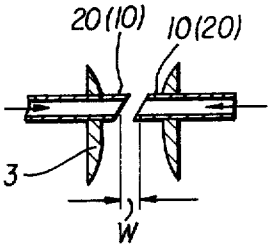
Figure 16:
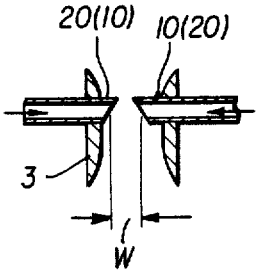

(2) The main fuel nozzle 10 or the air nozzle 20 is arranged at an inclination in the radial direction of the small venturi 3, as schematically shown in FIG. 12.

(3) The main fuel nozzle 10 or the air nozzle 20 has its opening surface inclined in the longitudinal direction of the small venturi 3, as schematically shown in FIG. 13, 14, 15 or 16. In the case of these inclined opening surfaces, the center distance between the openings of the two nozzles is assumed to represent the spacing W between the two nozzles.

Figure 17:
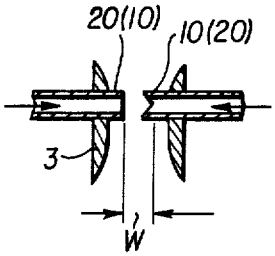
Figure 18:
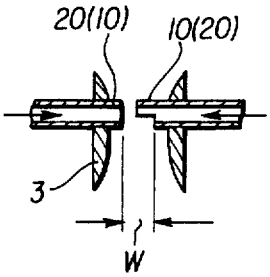
Figure 19:
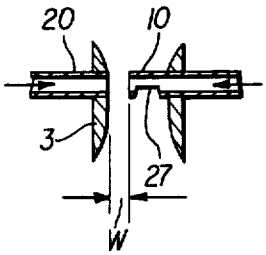
Figure 20:
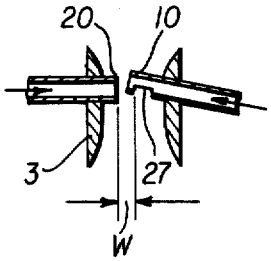
Figure 21:
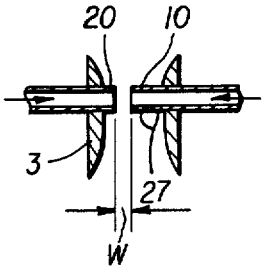

(4) The main fuel nozzle 10 or the air nozzle 20 has its leading end formed either into a "V" shape, as schematically shown in FIG. 17, or into a stepped shape, as schematically shown in FIG. 18. (5) The main fuel nozzle 10 is formed with an injection notch 27 in the vicinity of the opening thereof at the outlet side of the small venturi 3, as shown in FIG. 19, 20 or 21.

Figure 22:
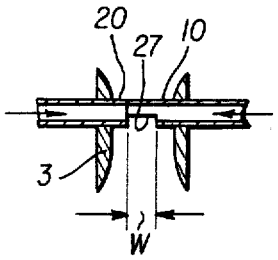
Figure 23:
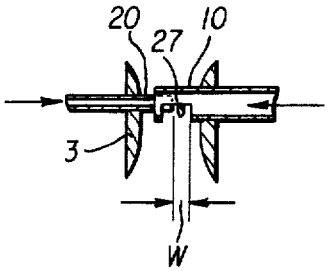

(6) The main fuel nozzle 10 and the air nozzle 20 are connected at their openings, as schematically shown in FIG. 22 or 23, and are formed with the injection notch 27 in the vicinity of the connected portion thereof at the outlet side of the small venturi 3 thereby to afford a similar effect to that in case the dis-bar is provided.

Figure 24:
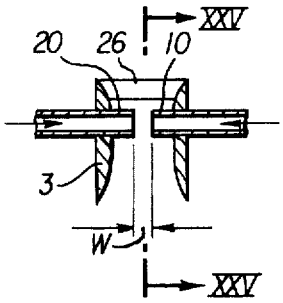
Figure 25:
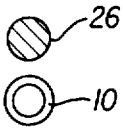

(7) The dis-bar 26 is not disposed on the two nozzles 10 and 20 but is disposed at a spacing from the two nozzles 10 and 20, as shown in FIGS. 24 and 25.

(8) The venturi is of the single or tripple type. Moreover, the carburetors according to the third to sixth preferred embodiments belonging to the second example of the first aspect in the present invention are of the type, in which the air fed under pressure out of a pressurized air source to inject from the air nozzle is made to impinge upon the fuel to be sucked from the main nozzle by the vacuum pressure in the venturi so that the flow rate of the fuel from the main nozzle may be controlled by the impinging force of the air from the air nozzle, and contemplated to prevent the impinging force of the air from the air nozzle from being weakened thereby to widen the controllable range of the air-fuel ratio of the mixture.

In order to attain this contemplation, the Inventors have conducted a series of experiments by varying the diameter $d_a$ of the air nozzle, the spacing W between the two nozzles or the eccentricity inbetween.

EXPERIMENT 1

Figure 26:
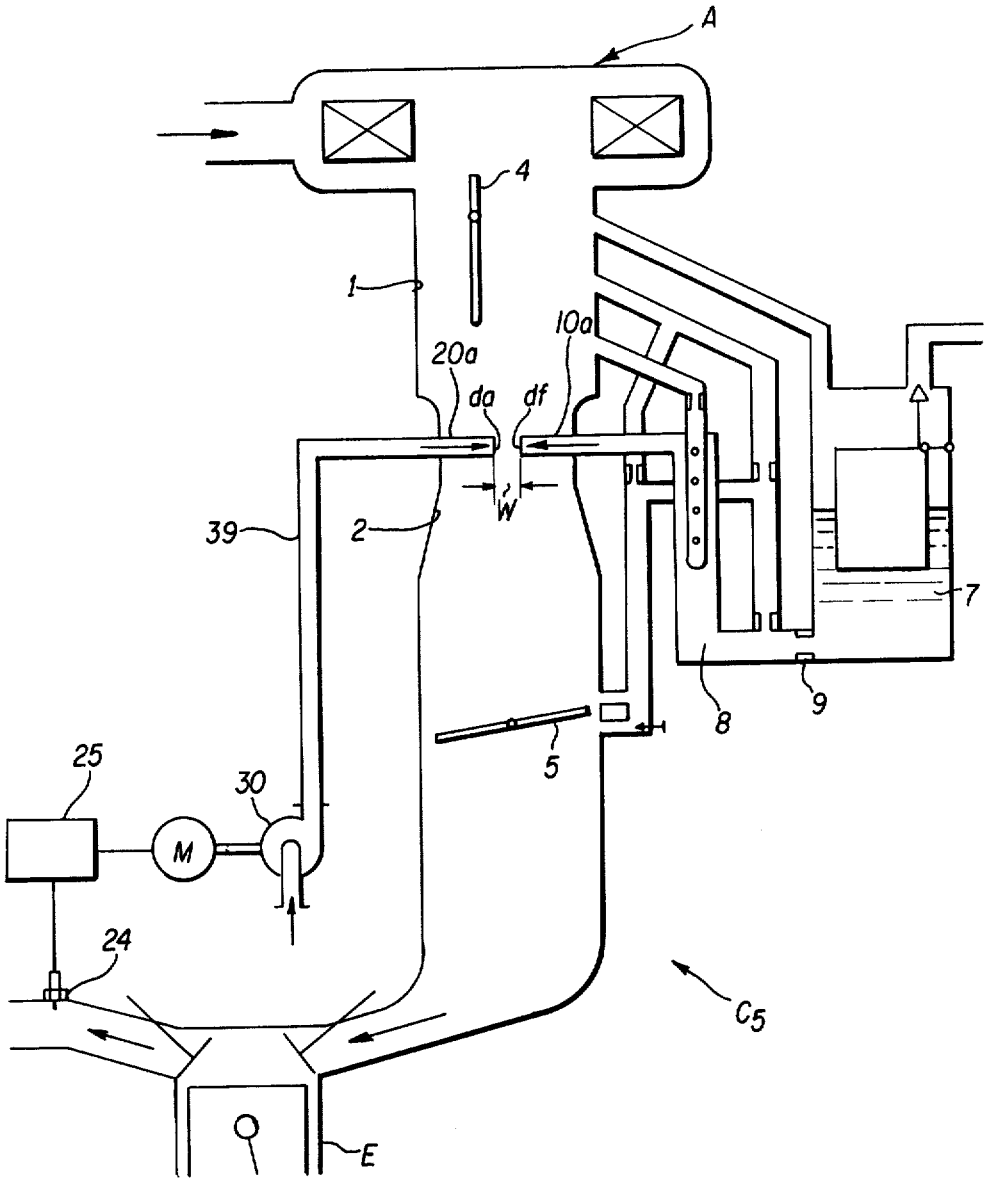
FIG. 26 is a schematic view showing the jet control carburetor used in Experiments 1, 2, 5 and 6 for the third to sixth embodiments of the present invention.
Figure 27:
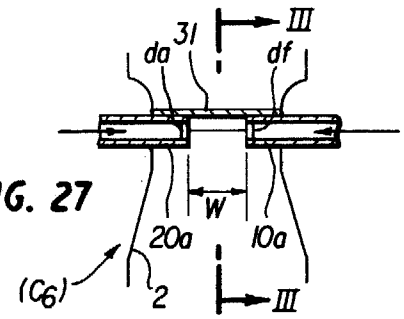
FIGS. 27 and 28 are respectively a longitudinal section and a partically enlarged transverse section showing the jet control carburetor used in Experiments 3 and 4 for the third to sixth embodiments of the present invention.
Figure 28:
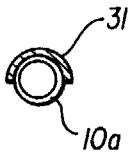

In this Experiment 1, a carburetor $C_5$ having no dis-bar was employed, as shown in FIG. 26. In this carburetor $C_5$, in case two nozzles 10*a* and 20*a* were coaxially arranged with each other with their eccentricity being set at zero, in case the spacing W between the two nozzles 10*a* and 20*a* was set at 15 or 7.5 times or equal to the inner diameter $d_a$ of the air nozzle 20*a*, and in case the ratio $d_a/d_f$ of the inner diameter $d_a$ of the air nozzle 20*a* to the inner diameter $d_f$ of the main fuel nozzle 10*a* was set at various values, both the flow rate $V_O$ of the fuel from the main nozzle 10*a* when the rpm of an air pump 30 was set at the maximum (or when the discharge pressure of the air pump 30 was about 0.5 $kg/cm^2$) and the flow rate $V_S$ of the fuel from the main fuel nozzle 10*a* when the air pump 30 was stopped were measured to obtain the ratio $V_O/V_S$ of the former flow rate $V_O$ to the latter flow rate $V_S$.

The case, in which the flow rate ratio $V_O/V_S$ approaches 1.0, means that the impinging force of the air from the air nozzle 20a is so weak that the control effect of the flow rate of the fuel from the main fuel nozzle 10a is reduced and accordingly it becomes difficult to accurately control the air-fuel ratio of the intake mixture are narrow.

On the contrary, the case, in which the flow rate ratio $V_O/V_S$ approaches 0, means that the impinging force of the air from the air nozzle 20a is so strong that enough control effect of the fuel from the main nozzle 10a is provided and accordingly the air-fuel ratio of the mixture is accurately controlled.

Figure 29:
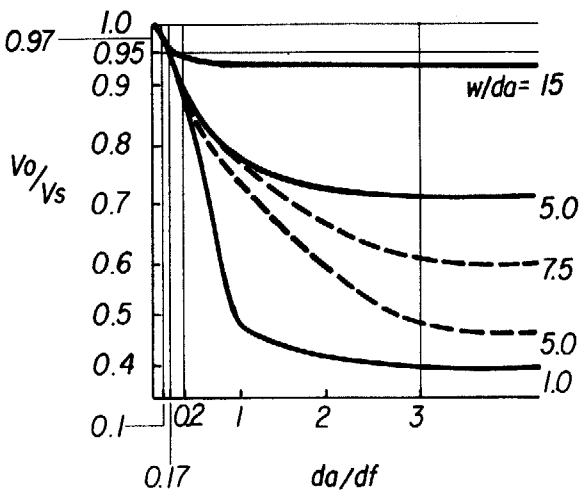
FIG. 29 is a graphical presentation showing the relationship between the ratio $V_O/V_S$ of the fuel flow rate $V_O$ in case there is an air flow from the air nozzle to the fuel flow rate $V_S$ in case there is no air flow and the ratio $d_a/d_f$ of the inner diameter $d_a$ of the air nozzle to the inner diameter $d_f$ of the fuel nozzle.

The relationship obtained by the aforementioned experiments between the flow rate ratio $V_O/V_S$ of the fuel and the diameter ratio $d_a/d_f$ of the two nozzles is shown in solid curves in FIG. 29. In view of this graph, it is understood that, if the inner diameter $d_a$ of the air nozzle is so reduced that the diameter ratio $d_a/d_f$ becomes smaller than 0.17, the flow rate ratio $V_O/V_S$ of the fuel becomes larger than 0.95 so that the impinging force of the air from the air nozzle 20a is markedly weakened to accordingly enough control effect cannot be obtained. As a result, in these third to six embodiments the diameter ratio $d_a/d_f$ between the two nozzles is limited to a value not smaller than 0.17. ($d_a/d_f \geqq 0.17$)

If, on the contrary, the inner diameter $d_a$ is so enlarged that the diameter ratio $d_a/d_f$ becomes larger than 3, the ratio of the flow rate of the air to be used to impinge upon the fuel spurting from the main fuel nozzle 10a to the flow rate of the whole air injected from the air nozzle 20a is so reduced that considerable effects cannot be expected even if the diameter $d_a$ of the air nozzle is enlarged.

Still the worse, when the air pump 30 is stopped or when the electromagnetic valve 25 is under its closed condition, a portion of the fuel spurting from the main nozzle 10 steal to reside in the air nozzle 20a, and the fuel thus residing in the air nozzle 10a may frequently flow out for some cause so that the air-fuel ratio of the intake mixture will fluctuate unexpectedly in high amplitudes.

Therefore, if consideration is taken into a disadvantage which takes place in case the inner diameter $d_a$ of such air nozzle becomes more than several times that $d_f$ of the main fuel nozzle, the diameter ratio $d_a/d_f$ between the two nozzles is preferably not larger than 3, ($d_a/d_f \leqq 3$). The best result can be obtained the diameter ratio $d_a/d_f$ between the two nozzles is about 1, ($d_a/d_f = 1$).

EXPERIMENT 2

In Experiment 2, the aforementioned carburetor $C_5$ having no dis-bar, was also employed. In this carburetor $C_5$, in case the two nozzles 10 and 20a were coaxially arranged with each other, in case the inner diameter ratio $d_a/d_f$ between the two nozzles was set at 1, 3 or 4, and in case the ratio $W/d_a$ of the spacing W between the two nozzles to the diameter $d_a$ of the air nozzle was set at various values, the ratio $V_O/V_S$ of the flow rate $V_O$ of the fuel spurting from the main fuel nozzle 10a when the air pump 30 was stopped to the flow rate $V_S$ of the fuel from the main fuel nozzle when the rpm of the air pump was set at the maximum was obtained. Then, the relationship between the flow rate ratio $V_O/V_S$ and the ratio $W/d_a$ of the spacing W between the two nozzles to the diameter $d_a$ of the air nozzle is shown in solid curves in FIG. 30. From this graph, it can be apparently understood that, if the spacing W between the two nozzles so enlarged that its ratio $W/d_a$ to the diameter $d_a$ of the air nozzle becomes larger than 15, the flow rate ratio $V_O/V_S$ of the flow exceeds 0.95 so that impinging force of the air from the air nozzle 20a is markedly weakened to accordingly narrow the controllable range of the air-fuel ratio of the intake mixture. Therefore, the ratio $W/d_a$ of the spacing W between the two nozzles to the inner diameter $d_a$ of the air nozzle is limited to a value not larger than 15. ($W/d_a \leqq 15$)

Figure 30:
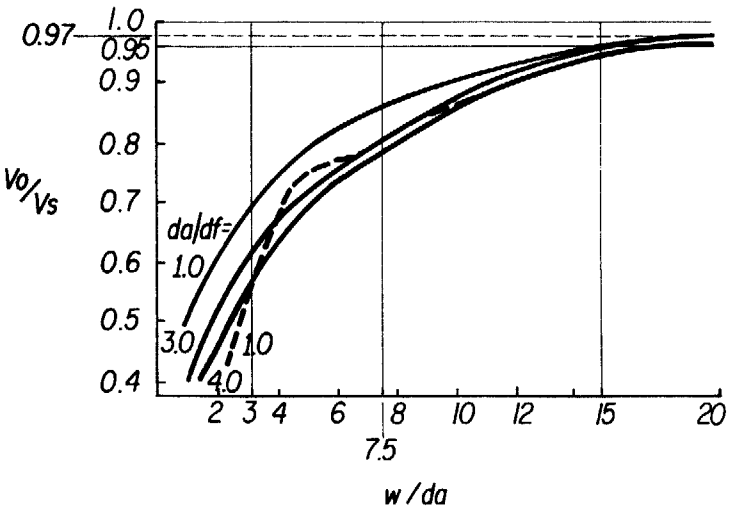
FIG. 30 is a graphical presentation showing the relationship between the ratio $V_O/V_S$ of the fuel flow rate $V_O$ to the fuel flow rate $V_S$ and the ratio $W/d_a$ of the spacing W between the main fuel nozzle and air nozzle to the inner diameter $d_a$ of the air nozzle.

As is apparent from the solid curves of FIG. 30, moreover, the ratio $W/d_a$ of the spacing W between the two nozzles to the diameter $d_a$ of the air nozzle is preferably not larger than 3. ($W/d_a \leqq 3$)

Here, if the spacing W between the two nozzles is so reduced that its ratio $W/d_a$ to the diameter $d_a$ of the air nozzle becomes markedly small, the air nozzle 20a itself blocks the fuel flow out of the main fuel nozzle 10a, even when the air pump 30 is stopped, so that the flow rate of the fuel from the main nozzle 10a is reduced.

On the other hand, since the flow rate ratio $V_O/V_S$ of the fuel from the main nozzle 10a becomes very small, a large error is invited in the flow rate of the fuel from main fuel nozzle 10a even with a small error in the rpm of the air pump 30.

Therefore, if consideration is taken into the aforementioned disadvantage in case the spacing W between the two nozzles becomes remarkably small, the ratio $W/d_a$ of the spacing W between the two nozzles to the diameter $d_a$ of the air nozzle is preferably not smaller than 0.2, although not shown in the graph of FIG. 30. The best result can be obtained for the ratio having a value of about 1.

EXPERIMENT 3

In Experiment 3, a carburetor $C_6$ equipped with a dis-bar 31, was employed. In this carburetor $C_6$, in case the ratio $W/d_a$ of the spacing W between the two nozzeles to the diameter of the air nozzle was set at 7.5 or 5, while making others similar to those of the Experiment 1 without any dis-bar, the relationship shown in broken lines in FIG. 29 was obtained between the flow rate ratio $V_O/V_S$ of the fuel and the diameter ratio $d_a/d_f$ between the two nozzles. As is apparent from the graph of FIG. 29, the diameter ratio $d_a/d_f$ between the two nozzles is limited to a value not smaller than 0.17, even in case the dis-bar 31 is provided.

Moreover, by the same reason as the case of the Experiment 1 having no dis-bar, the diameter ratio $d_a/d_f$ between the two nozzles is preferably not larger than 3 and the best at about 1.

EXPERIMENT 4

In Experiment 4, the aforementioned carburetor $C_6$ equipped with the dis-bar 31, was also employed. In this carburetor $C_6$, the diameter ratio $d_a/d_f$ between the two nozzles was set at 1.0, while making others the same as the case of the Experiment 2 without any dis-bar, and the relationship shown in broken curves in FIG. 30 was obtained between the flow rate ratio $V_O/V_S$ of the fuel and the ratio $W/d_a$ of the spacing W between the two nozzles to the inner diameter $d_a$ of the air nozzle. As is apparent from the broken curves of FIG. 30, the ratio $W/d_a$ of the spacing W between the two nozzles to the diameter $d_a$ of the air nozzle is limited to a value not larger than 15 even in case the dis-bar 31 is provided.

Moreover, as is also apparent from the broken curves of FIG. 30, the ratio $W/d_a$ of the spacing W between the two nozzles to the inner diameter $d_a$ of the air nozzle is preferably not larger than 7.5.

Here, the ratio $W/d_a$ of the spacing W between the two nozzles to the diameter $d_a$ of the air nozzle is preferably not smaller than 0.2, because a similar disadvantage to that in the case of the Experiment 2 without any dis-bar results if that ratio becomes markedly small. The best result is obtained for the ratio of 2.

EXPERIMENT 5

Figure 31:
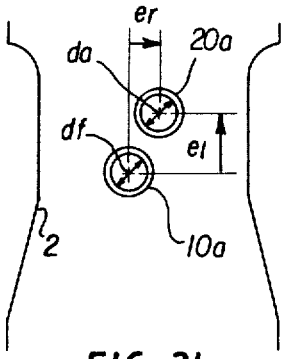
FIG. 31 is a schematic view showing the conditions of a predetermined distance $e_l$ of the air nozzle to the fuel nozzle along the axial direction of the venturi and of a predetermined distance $e_r$ thereof to the fuel nozzle along the radial direction of the venturi in a carburetor used in Experiment 5 for the third to sixth embodiments of the present invention.

In Experiment 5, the aforementioned carburetor $C_5$ having no dis-bar, was employed. In this carburetor $C_5$, in case the diameter ratio $d_a/d_f$ between the two nozzles was set at 1, in case the ratio $W/d_a$ of the spacing W between the two nozzles to the diameter $d_a$ of the air nozzle was set at 1, in case the predetermined distance $e_r$ (or the eccentricity $e_r$) of the air nozzle 20*a* along the radial direction of the venturi 2 with respect to the main nozzle 10*a*, as shown in FIG. 31, was set at zero, and in case the predetermined distance $e_l$ (or the eccentricity $e_l$) of the air nozzle 20*a* along the axial direction of the venturi 2 with respect to the center axis of the main nozzle 10*a*, as shown in FIG. 31, was set at various values against the diameter $d_a$ of the air nozzle, the ratio $V_O/V_S$ of the flow rate $V_O$ of the fuel from the main nozzle when the rpm of the air pump 30 was maximized to the flow rate $V_S$ of the fuel from the main nozzle 10*a* when the air pump 30 was stopped was obtained.

Figure 32:
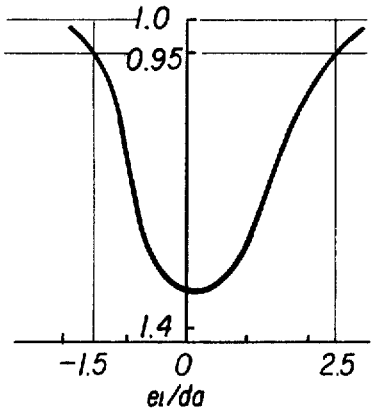
FIG. 32 is a graphical presentation showing the relationship between the flow rate ratio $V_O/V_S$ of the fuel and the ratio $e_l/d_a$ of the predetermined distance $e_l$ of the air nozzle along the axial direction of the venturi to the inner diameter $d_a$ of the air nozzle.

The relationship between the flow rate ratio $V_O/V_S$ of the fuel and the ratio $e_l/d_a$ of the axial distance or $e_l$ of the air nozzle along the axial direction of the venturi 2 to the diameter $d_a$ of the air nozzle is shown in FIG. 32.

As is apparent from this graph, when the eccentricity $e_l$ of the air nozzle 20*a* to the inlet side of the venturi 2 exceeds two and half times the diameter $d_a$ of the air nozzle, or when the axial distance or eccentricity $-e_l$ of the air nozzle 20*a* to the outlet side of the venturi 2 exceeds one and half times the diameter $d_a$ of the air nozzle, the flow rate ratio $V_O/V_S$ of the fuel becomes larger than 0.95 so that the impinging force of the air injected from the air nozzle 20*a* is remarkably weakened to accordingly narrow the controllable range of the air-fuel ratio of the intake mixture.

Therefore, the eccentricity $e_l$ of the air nozzle 20*a* along the axial direction of the venturi to the inlet side of the venturi 2 is limited to a value not larger than two and half times the diameter $d_a$ of the air nozzle. On the other hand, the eccentricity $-e_l$ of the air nozzle 20*a* to the outlet side of the venturi 2 is limited to a value not larger than one and a half times the diameter $d_a$ of the air nozzle.

Incidentally, the reason why the allowable eccentricity of the air nozzle 20*a* to the inlet side of the venturi 2 is larger than the allowable value of the air nozzle 20*a* to the outlet side of the venturi 2 is based upon the fact that the air flow injected from the air nozzle 20*a* is deflected toward the outlet side of the venturi 2 by the intake air flowing within the venturi 2 from the inlet to the outlet.

Moreover, the best result is obtained in case the center axis of the air nozzle 20*a* is not eccentric along the longitudinal or axial direction of the venturi 2 with respect to the center axis of the main nozzle 10*a*., i.e., in case the two nozzles are positioned coaxially to each other.

EXPERIMENT 6

In Experiment 6, the aforementioned carburetor $C_5$ having no dis-bar, was also employed. In this carburetor $C_5$, in case both the ratio $W/d_a$ of the spacing W between the two nozzles to the diameter $d_a$ of the air nozzle and the diameter ratio $d_a/d_f$ between the two nozzles were set at 1, in case the eccentricity $e_l$ of the center axis of the air nozzle 20*a* along the axial direction of the venturi 2 with respect to the center axis of the main nozzle 10*a* was set at zero, and in case the eccentricity $e_r$ of the air nozzle 20*a* along the radial direction of the venturi 2 with respect to the center axis of the main nozzle 10*a* was set at various values against the inner diameter $d_a$ of the venturi 2, the flow rate ratio $V_O/V_S$ of the fuels spurting from the main fuel nozzle 10*a*, respectively, when the air pump 30 was revolving at the maximum speed and stopped, was obtained.

Figure 33:
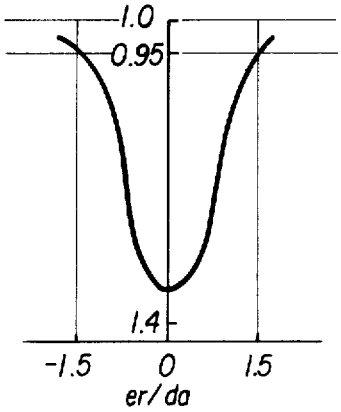
FIG. 33 is a graphical presentation showing the relationship between the flow rate ratio $V_O/V_S$ of the fuel and the ratio $e_r/d_a$ of the predetermined distance $e_r$ of the air nozzle in the radial direction of the venturi to the inner diameter $d_a$ of the air nozzle.

The relationship between the flow rate ratio $V_O/V_S$ of the fuel and the ratio $e_r/d_a$ of the eccentricity $e_r$ of the air nozzle 20*a* in the radial direction of the venturi 2 to the diameter $d_a$ of the air nozzle is shown in FIG. 33. As is understood from this graph, the eccentricities $e_r$ and $-e_r$ of the center axis of the air nozzles 20*a* in the radial direction of the venturi 2 with respect to the center axis of the main nozzle 10*a* are limited to a value not larger than one and a half times the diameter $d_a$ of the air nozzle.

It is apparent that the best result can be obtained in case the center axis of the air nozzle 20*a* is not eccentric in the radial direction of the venturi 2 with respect to the center axis of the main nozzle 10*a*, i.e., the two nozzles are positioned in axial alignment with each other.

Figure 34:
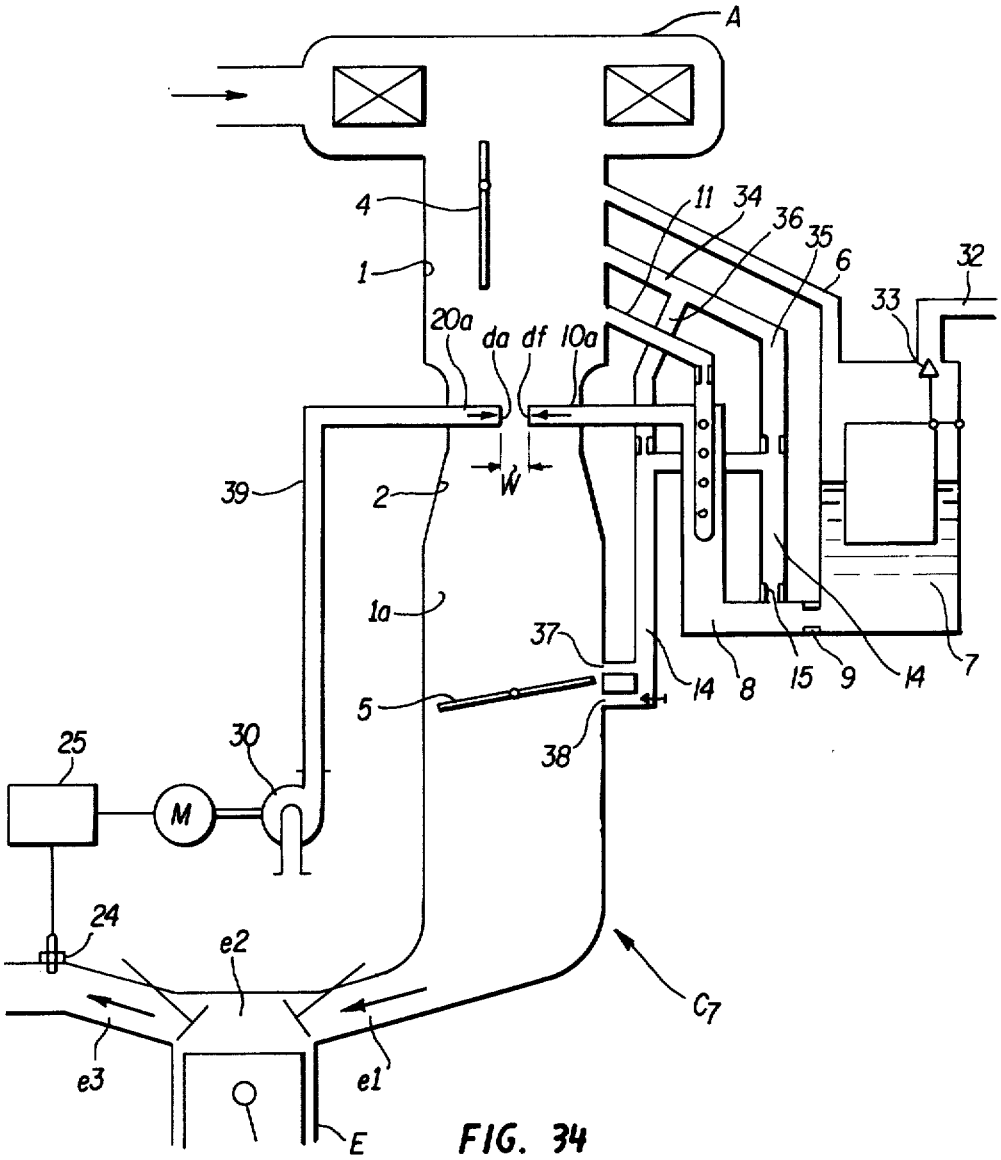
FIG. 34 is a schematic view showing the jet control carburetor according to a third embodiment of the present invention.

A carburetor $C_7$ according to the third embodiment of the present invention is constructed, as schematically shown in FIG. 34.

More specifically, the air cleaner A has its outlet connected with the upper end inlet of the intake pipe 1 whereas the engine E has its intake manifold $e_1$ connected with the lower end outlet of the same. The venturi 2 is formed at a center portion of the intake pipe 1. The choke valve 4 and the throttle valve 5 are disposed at positions above and below the venturi 2 of the intake pipe 1. The float chamber 7 equipped with a float is disposed sideway of the center portion of the intake pipe 1. On end portion (ceiling portion) of the float chamber 7 communicates with the upper portion of the intake pipe 1 through the air vent tube 6. On the other hand, a now-shown fuel pump is connected with the ceiling of the float chamber 7 through a fuel tube 32. A needle, which is made to protrude from the upper side of a float made movable up and down in accordance with the fuel level in the float chamber 7, is disposed to face the fuel outlet of the fuel tube 32 thereby to constitute a float needle 33 for maintaining the fuel level in the float chamber 7 at a constant level. The main fuel passage 8 has its inlet connected with the other portion (the bottom) of the float chamber 7. The jet 9 is disposed in the main fuel passage 8 in the vicinity of the inlet thereof. The main bleed air passage 11 has its inlet connected to the upper portion of the intake pipe 1 and its outlet connected to a midway portion of the main fuel passage 8. The main fuel nozzle 10*a* having a circular cross-section and connected to the outlet of the main fuel passage 8 is opened to protrude into the venturi 2. The opening of the main fuel nozzle 10*a* is formed in the throat of the venturi 2 which is arranged at a higher level than the fuel level in the float chamber 7. The slow fuel passage 14 has its inlet connected to the main fuel passage 8 just downstream of the jet 9. The jet 15 is disposed in the slow fuel passage 14 in the vicinity of the inlet thereof. The first branch 35 and the second branch 36 of a slow bleed air passage 34, which is connected to the upper portion of the intake pipe 1, are connected, respectively, to the upstream and downstream portions of the midway horizontal portion 14a of the slow fuel passage 14, which portion 14a is arranged at a higher position than the fuel level of the float chamber 7. The slow port 37 and the idle port 38 constituting the outlet of the slow fuel passage 14 are opened in the intake air passage 1a in the vicinity of the throttle valve 5. Incidentally, there are also provided the power fuel system and the acceleration fuel passage, although not shown.

In the carburetor $C_7$ according to the third embodiment of the present invention, moreover, as schematically shown in FIG. 34, the air nozzle 20a of circular cross-section connected to the outlet of a control air passage 39 is made to protrude into the venturi 2 and is opened at a position to face the main fuel nozzle 10a. These two nozzles 10a and 20a are coaxially arranged with each other to set their eccentricity at zero. The diameters $d_f$ and $d_a$ of the two nozzles 10a and 20a are set to have the same size. Moreover, the spacing W between the two nozzles 10a and 20a is set at the same size as the diameter $d_a$ of the air nozzle 20a.

The control air passage 39 has its inlet connected with the discharge port of the rotary type air pump 30. This air pump 30 is rotationally driven by the motor M and has its suction port vented to the atmosphere. The engine E has its exhaust manifold $e_3$ equipped with the oxygen sensor 24 which is made operative to generate a voltage having a level according to the oxygen concentration in the exhaust gases. There is further provided the electronic control unit 25 for increasing and decreasing the rpm of the motor M for the air pump 30 in accordance with the output voltage of the oxygen sensor 24. Thus, the closed loop control system for the main fuel comprises the main nozzle 10a, the intake pipe 1, the intake manifold $e_1$, the combustion chamber $e_2$ and the exhaust manifold $e_3$ of the engine E, the oxygen sensor 24, the electronic control unit 25, the motor M, the air pump 30, the control air passage 39, and the air nozzle 20a.

In the carburetor $C_7$ according to the third embodiment, air is sucked into the intake pipe 1 through the air cleaner A by the rotational drive of the engine E. During the high speed running operation of the engine E with the throttle valve 5 being fully open, the fuel in the float chamber 7 is sucked under its emulsion condition through the main fuel passage 8 from the opening of the main fuel nozzle 10 by the vacuum pressure built up in the throat of the venturi 2. As a result, a combustible mixture is prepared with both the fuel sucked into the intake pipe 1 and the intake air flowing through the intake passage and is fed to the combustion chamber $e_2$ of the engine.

Here, the control air is injected through the control air passage 39 from the air nozzle 20a by the rotations of the air pump 30 driven by the motor M and is made to impinge upon the fuel sucked from the main fuel nozzle 10a thereby to weaken the force for injecting the fuel from the main fuel nozzle 10a so that the flow rate of the fuel spurting from the main nozzle 10a is reduced. And, the flow rate of the fuel spurting from the main fuel nozzle 10a is increased and decreased in accordance with the rpm of the air pump 30 by the motor M, i.e., the discharge pressure or flow rate of the air pump. Thus, if the rpm of the air pump 30 is decreased, the impinging force of the air injected from the air nozzle 20a is weakened so that the flow rate of the fuel is increased thereby to reduce the air-fuel ratio of the intake mixture. On the contrary, if the rpm of the air pump 30 is increased, the impinging force of the air injected from the air nozzle 20a is strengthened so that the flow rate of the fuel is decreased thereby to increase the air-fuel ratio of the intake mixture.

In the carburetor $C_7$ according to the third embodiment of the present invention, if the oxygen concentration in the exhaust gases of the engine E, which is detected by the oxygen sensor 24, is higher than a reference value, i.e., if the air-fuel ratio of the intake mixture to be fed to the engine E is higher than a proper value (a lean mixture condition), the control unit 25 reduces the rpm of the motor M and accordingly the rpm of the air pump 30 thereby to increase the flow rate of the fuel from the main fuel nozzle 10a so that the air-fuel ratio of the intake mixture is reduced to the proper value. On the contrary, if the oxygen concentration in the exhaust gases in the engine E is lower than the reference value (a rich mixture condition), the control unit increases the rpm of the motor M and accordingly the rpm of the air pump 30 thereby to decrease the flow rate of the fuel from the main nozzle 10a so that the air-fuel ratio of the intake mixture is enlarged to the proper value.

The carburetor $C_7$ according to the third embodiment is constructed such that the main fuel nozzle 10a and the air nozzle 20a are so coaxially arranged with each other as to have their eccentricity set at zero, such that the diameter $d_f$ and $d_a$ of the two nozzles 10a and 20a are set to have the same size, and such that the spacing W between the two nozzles 10a and 20a is set to have the same size as the diameter $d_a$ of the air nozzle. As is apparent from the aforementioned experiments 1,2, 5 and 6, therefore, the impinging force of the air injected from the air nozzle is not remarkably weakened so that the variable range of the flow rate of the fuel from the main fuel nozzle by that impinging force and accordingly the controllable range of the air-fuel ratio of the intake mixture can be kept wide. Moreover, the carburetor $C_7$ can be free from the aforementioned disadvantage which might otherwise be experienced in case the diameter $d_a$ of the air nozzle is larger than several times the diameter $d_f$ of the main fuel nozzle or in case the spacing W between the two nozzles becomes much smaller than the diameter $d_a$ of the air nozzle.

Figure 35:
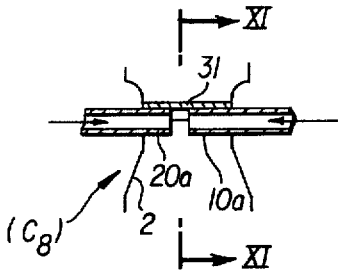
FIGS. 35 and 36 are respectively a longitudinal section and a partially enlarged transverse section showing the jet control carburetor according to a fourth embodiment of the present invention.
Figure 36:
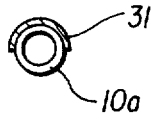
Figure 39:
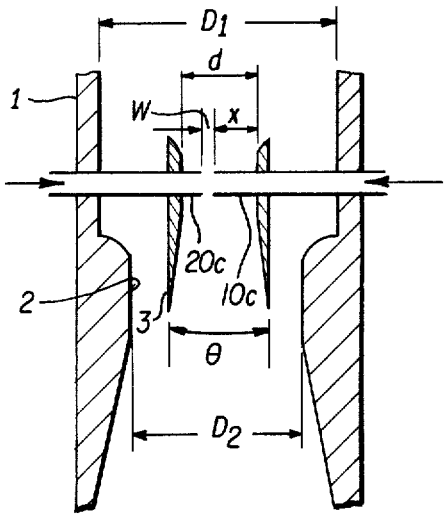
FIG. 39 shows an atomized and distributed condition of the fuel in case the ratio x/d, of the length x of protrusion of the main fuel nozzle to the inner diameter d of the venturi, is set at about 0.6.

In a carburetor $C_8$ according to a fourth embodiment of the present invention, as partially and schematically shown in FIGS. 35 and 36, the dis-bar (distribution bar) 31 having a semicircular cross-section is arranged to extend at the inlet side of the venturi 2 across the main fuel nozzle 10a and the air nozzle 20a, which have the same diameter and which are made to coaxially protrude into the venturi 2 in a manner to face each other, along the outer circumferences thereof. Moreover, the spacing W between the two nozzles 10a and 20a is set twice the diameter $d_a$ of the air nozzle, ($W/d_a=2$). Incidentally, other portions are similar to those of the preceding third embodiment carburetor $C_7$, and their repeated explanations will be omitted here.

The carburetor $C_8$ according to the fourth embodiment of the present invention is constructed such that the main fuel nozzle 10a and the air nozzle 20a coaxially arranged with each other have a diameter of the same size and such that the spacing W between the two nozzles 10a and 20a is set twice the diameter $d_a$ of the air nozzle, ($W/d_a=2$). As is apparent from the aforementioned Experiments 3 and 4, therefore, the impinging force of the air injected from the air nozzle is not remarkably weakened to accordingly widen the controllable range of the air-fuel ratio of the intake mixture.

Figure 37:
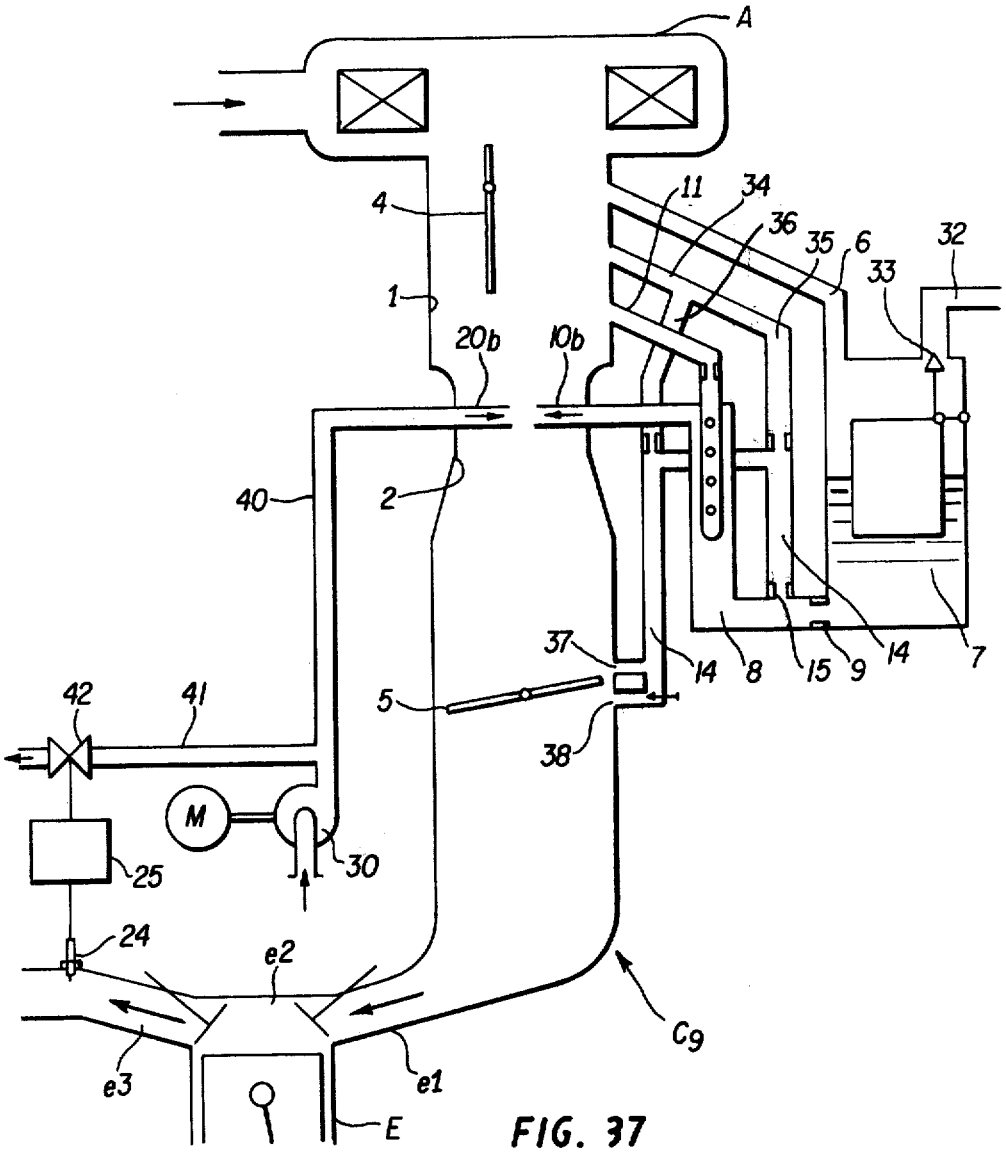
FIG. 37 is a longitudinal section showing the jet control carburetor according to a fifth embodiment of the present invention.

A carburetor $C_9$ according to a fifth embodiment of the present invention will now be described while stressing their portions different from those of the carburetor $C_7$ according to the third embodiment. As schematically shown in FIG. 37, an air nozzle 20*b* of a circular cross-section, which is connected with the outlet of a control air passage 40, is made to protrude into the venturi 2 such that it is coaxially opened to face a main fuel nozzle 10*b* having a circular cross-section. The spacing W between the two nozzles 10*b* and 20*b* having the same diameter is set to have the same size as the diameter $d_a$ of the air nozzle 20*b*. The control air passage 40 has its inlet connected with the discharge port of the rotary type air pump 30, which is rotationally driven at a constant speed by the motor M. This air pump 30 has its suction port vented to the atmosphere. An electromagnetic valve 42 acting as a kind of a control valve is disposed midway of the discharge air passage 41 which is branched from the vicinity of the inlet of the control air passage 40. The discharge air passage 41 has its outlet vented to the atmosphere. The engine E has its exhaust manifold $e_3$ equipped with the oxygen sensor 24 which is operative to generate a voltage in accordance with the oxygen concentration in the exhaust gases. There is provided the ON-OFF electronic control unit 25 for opening and closing the electromagnetic control valve 42 in a preset frequency thereby to increase and decrease the open time of the electromagnetic control valve during one cycle in accordance with the level of the output voltage of the oxygen sensor 24.

Thus, the closed loop control system of the main fuel comprises the main fuel nozzle 10*b*, the intake pipe 1, the intake manifold $e_1$, the combustion chamber $e_2$ and the exhaust manifold $e_3$ of the engine, the oxygen sensor 24, the ON-OFF electronic control unit 25, the electromagnetic control valve 42, the discharge air passage 41, the air pump 30, the control air passage 40, and the air nozzle 20*b*.

Incidentally, the portions similar to those of the carburetor $C_7$ according to the third embodiment are designated at the same reference numerals, and their repeated explanations will be omitted here.

In the carburetor $C_9$ thus constructed according to the fifth embodiment of the present invention, during the high speed running operation of the engine with the throttle valve 5 being fully open, the fuel in the float chamber 7 is sucked into the intake pipe under its emulsion condition through the main fuel passage 8 from the opening of the main nozzle 10*b* by the vacuum pressure in the throat of the venturi 2. On the other hand, the control air is injected through the control air passage 40 from the air nozzle 20*b* by the air pump 30, which is rotationally driven at a constant speed by the motor M. The control air thus injected from the air nozzle 20*b* is made to impinge upon the fuel sucked from the main nozzle 10*b* so that the force for injecting the fuel from the main nozzle 10*b* is weakened to reduce the flow rate of the fuel from the main nozzle 10*b*. And, the flow rate of the fuel from the main fuel nozzle is increased and decreased in accordance with the flow rate through the control air passage 40 and accordingly through the discharge air passage 41. If the open time of the electromagnetic control valve 42 of the discharge air passage 41 during one opening and closing cycle is elongated, the overall flow rate of the discharge air passage 41 is increased to inversely proportionately decrease the overall flow rate through the control air passage 40 so that the flow rate of the fuel from the main fuel nozzle 10*b* is increased to reduce the air-fuel ratio of the intake mixture. On the contrary, if the aforementioned open time of the electromagnetic control valve 42 is shortened, the overall flow rate of the discharge air passage 41 is decreased to inversely proportionately increase the overall flow rate through the control air passage 40 so that the flow rate of the fuel is decreased to increase the air-fuel ratio of the intake mixture. Therefore, if the oxygen concentration in the exhaust gases in the engine E, which is detected by the oxygen sensor 24, is higher than a reference value, i.e., if the air-fuel ratio of the intake mixture to be fed to the engine E is higher than a proper value (a lean mixture condition), the ON-OFF electronic control unit 25 elongates the aforementioned open time of the electromagnetic valve 42 so that the air-fuel ratio of the intake mixture is reduced to approach the proper value. On the contrary, if the oxygen concentration in the exhaust gases is lower than the reference value (a rich mixture condition), the ON-OFF electronic control unit 25 shortens the aforementioned open time of the electromagnetic control valve 42 so that the air-fuel ratio of the intake mixture is increased to approach the proper value.

The carburetor $C_9$ according to the fifth embodiment can enjoy a widened controllable range of the air-fuel ratio of the intake mixture similarly to the case of the carburetor $C_7$ according to the third embodiment.

In a carburetor according to the sixth embodiment, a dis-bar is additionally provided in the carburetor $C_9$ of the fifth embodiment similarly to the case of the carburetor $C_8$ of the fourth embodiment. Moreover, the spacing W between the main fuel nozzle and the air nozzle, which are coaxial with the same diameter and on which the dis-bar is arranged to extend, is set at twice the diameter of the air nozzle. Thus, the controllable range of the air-fuel ratio of the intake mixture can be widened similarly to the case of the carburetor $C_8$ according to the fourth embodiment.

The aforementioned carburetors according to the respective embodiments may be modified, as have been shown in FIGS. 12 to 25 and as will be exemplified in the following, to construct carburetors according to other embodiments.

(1) The venturi is modified into double or tripple type.

(2) In the carburetor $C_9$ according to the fifth embodiment, the air pump driven at a constant rotational speed is replaced by an air tank or another pressurized air source which is held under a constant pressure.

(3) In the above carburetor $C_9$, the control valve 42 is replaced by a flow regulating valve, and the ON-OFF electric control unit 25 is replaced by an analog control valve, which is operative to increase and decrease the opening of the above flow regulating valve in accordance with the output of the oxygen sensor 24 so that the flow rate through the discharge air passage 41 may be continuously increased and decreased in an analog manner. Then, as is quite different from the case of the carburetor $C_9$ of the fifth embodiment for accomplishing the ON-OFF control, no pulsation is established in the air flowing through the discharge air passage 41.

On the other hand, the electromagnetic valve 42 is replaced by a valve, which is operated hydraulically, pneumatically or by a linear motor or another motor, or by a flow regulating valve which has its opening stepwise increased and decreased by a step motor. Moreover, the ON-OFF electronic control unit 25 is replaced by a digital control circuit for stepwise increasing and decreasing the opening of the aforementioned flow regulating valve in accordance with the output of the oxygen sensor 24.

Now, the carburetors according to the preferred embodiments of the second aspect of the present invention will be described with reference to FIGS. 38 to 45.

A concrete carburetor according to the second aspect of the present invention is of the type, in which the air injected from the air nozzle is made to impinge upon the fuel spurting from the main nozzle so that the flow rate of the fuel from the main fuel nozzle may be controlled by the impinging force of the air from the air nozzle, and contemplates to improve the atomization and distribution of the fuel from the main nozzle at all times irrespective of the existence and strength of the impinging force of the air injected from the air nozzle.

The inventors have thought that the aforementioned contemplation can be effectively attained by the concept of limiting the length x of protrusion of the main fuel nozzle into the venturi within a preset range and have conducted a series of experiments by changing the length x of protrusion of the main nozzle.

Figure 38:
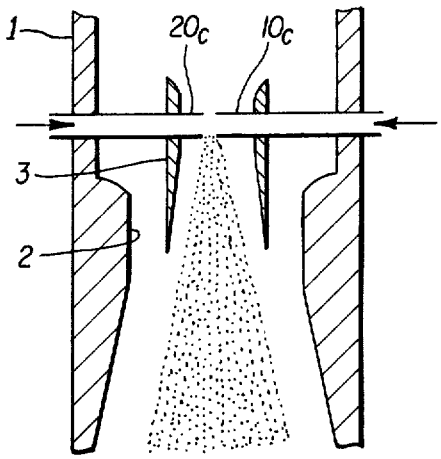
FIG. 38 is a partially schematic view in the longitudinal section showing the jet control carburetor used in Experiments for a second aspect of the present invention.

The carburetor used in the experiments is constructed, as partially shown in FIG. 38, such that the double venturi 2 and 3 are disposed in the intake pipe 1, such that a main fuel nozzle 10*c* and an air nozzle 20*c* are made to protrude toward each other into the throat of the small venturi 3, such that the intake pipe 1 has an inside diameter $D_1$ of 30 mm, such that the throat diameter $D_2$ of the main venturi 2 is 22 mm, such that the throat diameter d of the small venturi 3 is 10.72 mm, such that the angle $\theta$ of divergence at the outlet of the small venturi 3 is eight degrees, and such that the lengthes of protrusion of the two nozzles 10*c* and 20*c* can be increased and decreased while holding the spacing W between the two nozzles 10*c* and 20*c* at 1 mm.

In case the length x of protrusion of the main fuel nozzle 10*c* into the small venturi 3 is shortened to about 30% of the throat diameter d of the small venturi 3, the fuel sucked out of the main fuel nozzle is distributed widely and uniformly within the small venturi 3 and atomized to a satisfactory extent when no air is injected from the air nozzle 20*c*. On the contrary, when the control air is injected from the air nozzle 20*c* and made to impinge upon the fuel, which is sucked out of the main fuel nozzle 10*c*, thereby to restrain the suction of the fuel, then the fuel flow, which is sucked from the main fuel nozzle but stays in the vicinity of the inner circumferential wall of the small venturi 3 at the side of the main fuel nozzle 10*c*, is deflected toward the inner circumferential wall of the small venturi 3 at the side of the main fuel nozzle 10*c* by the pressure of the air flow from the air nozzle 20*c* so that the quantity of the fuel to wet the inner circumferential wall of the outlet portion of the small venturi 3 at the side of the main fuel nozzle 10*c* and accordingly the quantity of the fuel to fall in the form of large droplets from the circumferential edge of the outlet of the small venturi 3 at the side of the main nozzle 10*c* are increased. As a result, the atomization of the fuel is deteriorated, and the distribution of the fuel is offset toward the main fuel nozzle 10*c* and ununiformalized.

On the other hand, in case the length x of protrusion of the main nozzle 10*c* is elongated to about 80% of the throat diameter d of the small venturi 3, the fuel flow which is sucked out of the main nozzle 10*c* disposed in the vicinity of the inner circumferential wall of the small venturi 3 at the side of the air nozzle 20*c* is pushed toward the inner circumferential wall of the small venturi 3 at the side of the main fuel nozzle 10*c* by the action of the air flow from the air nozzle 20*c* until it comes to the center of the small venturi 3, when the control air is injected from the air nozzle 20*c* and made to impinge upon the fuel sucked from the main fuel nozzle 10*c* thereby to restrain the suction of the fuel, so that the fuel sucked from the main fuel nozzle 10*c* is distributed widely and uniformly within the small venturi 3 and atomized to a satisfactory extent. On the contrary, when no air is injected from the air nozzle 20*c*, the quantity of the fuel, which is sucked from the main nozzle in the vicinity of the inner circumferential wall of the small venturi 3 at the side of the air nozzle 20*c* so that it wets the inner circumferential wall of the outlet portion of the small venturi 3 at the side of the air nozzle, is so increased that the quantity of the fuel to fall in the form of large droplets from the circumferential edge of the outlet of the small venturi 3 at the side of the air nozzle 20*c* is accordingly increased. As a result, the atomization of the fuel is deteriorated, and the distribution of the fuel is offset toward the air nozzle 20*c* and ununiformalized.

On the contrary, in case the length x of protrusion of the main nozzle 10*c* is made not shorter than 30% of the throat diameter d of the small venturi 3 and not longer than 80% of the same ($0.3 \leqq x/d 0.8$), the fuel sucked from the main fuel nozzle 10*c* is distributed widely and uniformly within the small venturi 3 and atomized to a satisfactory extent with small droplet diameters irrespective of the running condition of the engine from high to low load range when the control air is injected from the air nozzle 20*c* or not. Especially in case the length x of protrusion of the main fuel nozzle is set at about 60% of the throat diameter d of the small venturi ($x/d=0.6$), the condition under which the fuel is atomized and distributed comes highly close the best ideal condition shown in FIG. 39.

Figure 40:
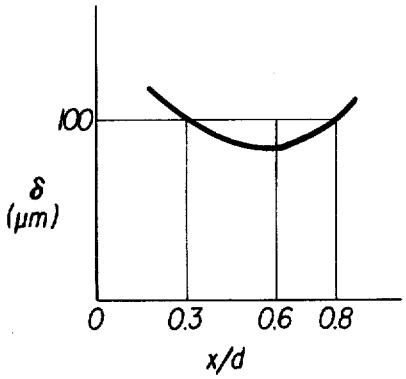
FIG. 40 is a graphical presentation showing the relationship between the Zauta mean diameter $\delta$ indicative of the atomized condition of the fuel and the ratio x/d of the length x of protrusion of the main fuel nozzle to the inner diameter d of the venturi.

As shown in FIG. 40, the relationship between the value, which is determined by summing up the Zauta ($\delta$) mean diameter indicative of the atomized condition of the fuel, i.e., such value as is determined by dividing the total volumes of the respective fuel droplets by the total surface areas of the same, for all the fuel droplets and the ratio x/d of the length x of protrusion of the main fuel nozzle 10*c* to the inner diameter d of the small venturi 3 is expressed by $\delta < 100\ \mu m$ in the range of $0.3 < x/d < 0.8$. The mean diameter $\delta$ takes its minimum for the range $0.55 < x/d < 0.65$ or presumably best for $x/d \simeq 0.6$.

A carburetor according to a preferred embodiment of the second aspect of the present invention will be described in the following.

Figure 41:
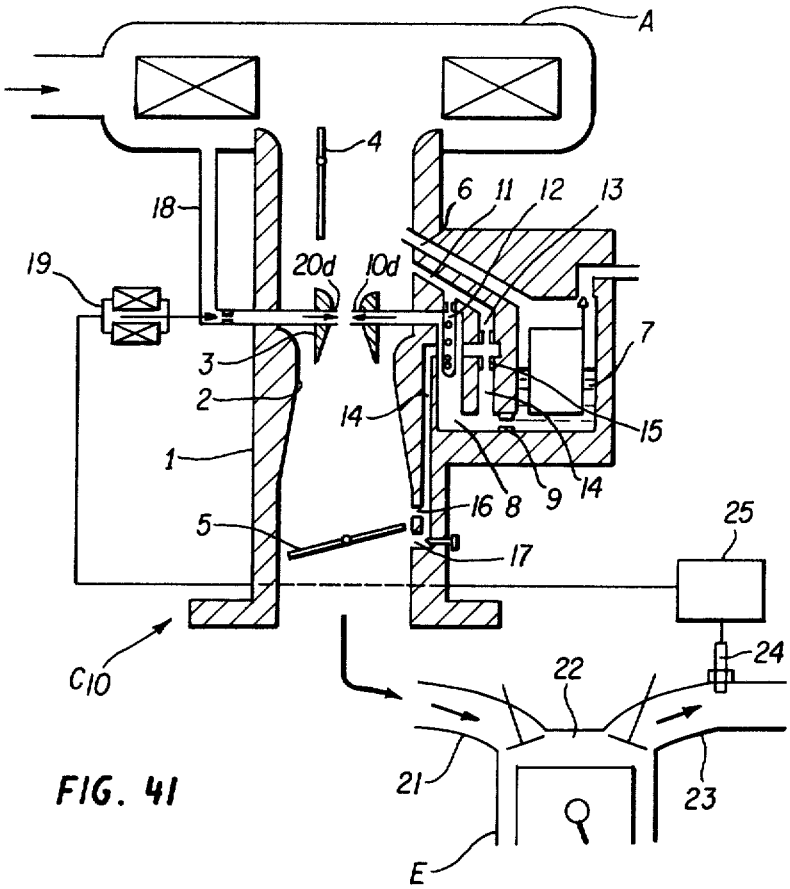
FIG. 41 is a schematic view showing the jet control carburetor according a seventh embodiment of the present invention.

In the carburetor $C_{10}$ according to the seventh embodiment of the present invention, as schematically shown in FIG. 41, the air cleaner A has its outlet connected to the upper end opening of the intake pipe 1 whereas the engine E has its intake manifold 21 connected to the lower end opening of the same. The main venturi 2 is disposed at the center portion of the inner circumferential wall of the intake pipe 1. The small venturi 3 has its outlet opening formed at the throat of the main venturi 2. The choke valve 4 and the throttle valve 5 are disposed, respectively, above the small venturi 3 and below main venturi 2 within the intake pipe 1. There is disposed sideway of the intake pipe 1 the float chamber 7 which is made to have communication with the upper portion of the intake pipe 1 through the air vent tube 6. The inlet of the main fuel passage 8, which is equipped with the jet 9, is connected to the float chamber 7. The main branch 12 of the bleed air passage 11, which is connected to the intake pipe 1, is in turn connected to a midway portion of the main fuel passage 8. The main fuel nozzle 10 at the outlet of the main fuel passage 8 is opened to protrude into the throat of the small venturi 3. The length x of protrusion of the main fuel nozzle 10 into the small venturi 3 is set at 60% of the throat diameter d of the small venturi 3 ($x/d=0.6$). The slow fuel passage 14, which is branched from the main fuel passage 8 just downstream of the jet 9, is equipped at its midway with the jet 15. The slow branch 13 of the bleed air passage 11 is connected to the midway portion of the slow fuel passage 14. The slow port 16 and the idle port 17 constituting the outlet of the slow fuel passage 14 are opened into the inner circumferential wall of the intake pipe 1 in the vicinity of the throttle valve 5. There are also provided the power fuel passage and the acceleration fuel passage, although not shown.

As schematically shown in FIG. 41, moreover, an electromagnetic control valve 19 as a throttle means is disposed midway of the control air passage 18 which has its inlet connected to the air cleaner A downstream of the filter element thereof. An air nozzle **20*a* at the outlet of the control air passage 18 is made to protrude into the small venturi 3 and is opened at a position where it faces a main fuel nozzle 10*d* having the same diameter. The engine E has its exhaust manifold 23 equipped with the oxygen sensor 24 which is operative to generate a voltage having a level according to the oxygen concentration in the exhaust gases. There is provided the electric control unit 25 which is operative to open and close the electromagnetic control valve 19 in a preset frequency so that the open time of the electromagnetic control valve 19 during one cycle may be increased and decreased in accordance with the level of the output voltage of the oxygen sensor 24**.

Thus, the closed loop control system comprises the main nozzle **10*d*, the intake pipe 1, the intake manifold 21, the combustion chamber 22 and the exhaust manifold 23 of the engine E, the oxygen sensor 24, the control circuit 25, the electromagnetic control valve 19, the control air passage 18, and the air nozzle 20*d***.

In the carburetor $C_{10}$ according to the seventh embodiment, air is sucked into the intake pipe 1 through the air cleaner A by the rotational drive of the engine E. During the high speed running operations of the engine E with the throttle valve 5 being fully open, the fuel under an emulsion condition is sucked out of the main fuel nozzle **10*d* by the vacuum pressure established in the small venturi 3. Then, an intake mixture is prepared with the fuel sucked under its emulsion condition into the intake pipe 1 and with the intake air flowing through the intake pipe 1 and is fed to the combustion chamber 22 of the engine E. On the other hand, when the electromagnetic control valve 19 is opened, communication is provided between the air filter A downstream of the filter element thereof and the air nozzle 20*d* so that the air is sucked out of the air nozzle 20*d* by the vacuum pressure in the small venturi 3. The air thus injected from the air nozzle 20*d* is made to impinge upon the fuel sucked from the main nozzle 10*d* thereby to weaken the force for making the fuel spurt from the main fuel nozzle 10*d* so that the quantity of the fuel from the main fuel nozzle is reduced to increase the air-fuel ratio of the intake mixture. If the open time of the electromagnetic control valve 19** during one opening and closing cycle is elongated, the overall air-fuel ratio of the mixture is accordingly increased. If the aforementioned open time is shortened, the overall air-fuel ratio of the mixture is accordingly reduced.

In the carburetor $C_{10}$ according to the seventh embodiment, therefore, if the oxygen concentration in the exhaust gases of the engine, which is detected by the oxygen sensor 24, is higher than a reference value, i.e., if the air-fuel ratio of the mixture to be fed to the engine E is higher than a proper value (a lean mixture condition), the electronic control unit 25 shortens the aforementioned open time so that the air-fuel ratio of the intake mixture is reduced to the proper value. On the contrary, if the oxygen concentration in the exhaust gases is lower than the reference value (a rich mixture condition), the electronic control unit 25 elongates the aforementioned open time of the electromagnetic control valve 19 so that the air-fuel ratio of the intake mixture is increased to the proper value.

The carburetor $C_{10}$ according to the seventh embodiment is so constructed that the length x of protrusion of the main fuel nozzle **10*d* into the small venturi 3 is set at 60% of the throat diameter d of the small venturi 3. As is apparent from the aforementioned experiments, therefore, the fuel spurting from the main fuel nozzle 10*d* is distributed widely and uniformly within the small venturi 3 and atomized stably and smoothly to a satisfactory extent at all times irrespective of the existence of the impinging force of the air from the air nozzle 20*d*. As a result, the carburetor $C_{10}$ can be free from mal distribution of fuel among the respective combustion chambers 22 of the engine E due to deterioration in the fuel distribution and atomization in the intake pipe 1 and from deterioration in combustions in the chambers 22** and emission of noxious exhaust gases.

The carburetor $C_{10}$ of the seventh embodiment, as has been schematically shown in FIG. 41, may be modified, as will be exemplified in the following.

Figure 42:
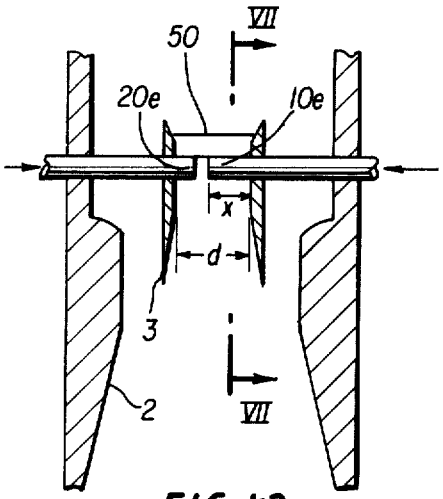
FIGS. 42 and 43 are respectively a longitudinal section and a partially enlarged transverse section showing the jet control carburetor having a dis-bar according to a modification of the seventh embodiment of the present invention.
Figure 43:
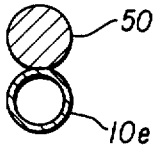

(1) As shown in FIGS. 42 and 43, a dis-bar 50 having a circular cross-section is arranged to extend at the inlet side of the small venturi 3 across the outer circumferential walls of the main fuel nozzle **10*e* and the air nozzle 20*e*, which are made to protrude into the throat of the small venturi 3 in a manner to face each other. The length x of protrusion of the main fuel nozzle 10*e* into the small venturi 3 is not shorter than 30% and not longer than 80% of the throat diameter d of the small venturi 3. In an alternative, the cross-sectional shape of the dis-bar 50 is formed into such an arc as extends along the outer circumferential walls of the main fuel nozzle 10*e* and the air nozzle 20*e***, or into an angular or flat shape.

With provision of the dis-bar 50, incidentally, it is possible to prevent the air flow, which is sucked out of the air nozzle **20*e* to impinge upon the fuel spurting from the main fuel nozzle 10*e*, from being keenly deflected by the intake air flow through the small venturi 3 thereby to remarkably weaken the impinging force of the air from the air nozzle 20*e*. As a result, the spacing between the two nozzles 10*e* and 20*e*** can be set widely.

Figure 44:
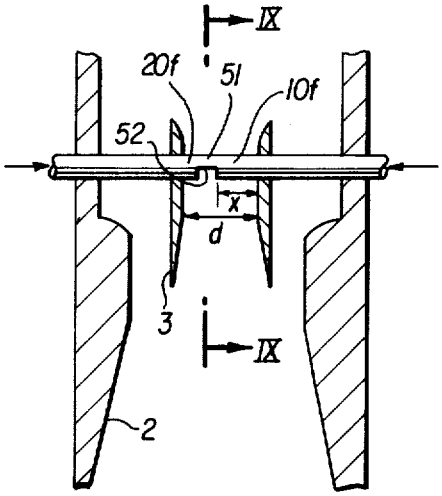
FIGS. 44 and 45 are respectively a longitudinal section and a partially enlarged transverse section showing the jet control carburetor including a single pipe provided with a notch according to another modification of the seventh embodiment of the present invention.
Figure 45:
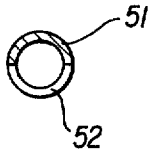

(2) As shown in FIGS. 44 and 45, a single pipe 51 is arranged to extend at the throat of the small venturi 3 to penetrate the intake pipe 1 and is partially cut away at the outlet side of the small venturi 3 thereby to form a notch for an injection port 52. The pipe 51 thus prepared has its one side used as a main fuel nozzle 10*f* and its other used as an air nozzle 20*f*. The length x of protrusion of the main fuel nozzle 10*f* into the small venturi 3 is made not shorter than 30% and not longer than 80% of the throat diameter d of the small venturi 3, ($0.3 \leqq x/d \leqq 0.8$).

(3) The diameter $d_a$ of the air nozzle 20*f* is made slightly larger or smaller than that $d_f$ of the main fuel nozzle 10*f*.

(4) The venturi is formed into single or tripple type.

Carburetors according to the preferred embodiments of the third aspect of the present invention will now be described with reference to FIGS. 46 to 54.

Figure 46:
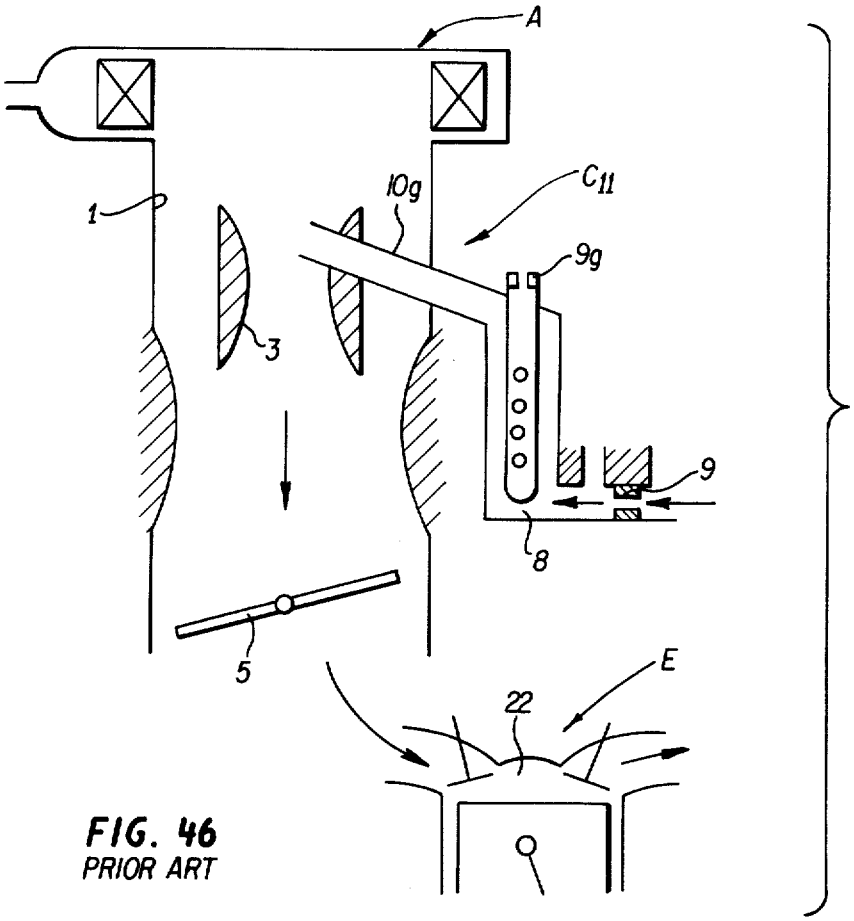
FIG. 46 PRIOR ART
FIG. 46 is a schematic view showing a further carburetor according to the prior art.

Incidentally, in the carburetor according to the prior art, as shown in FIG. 46, the intake air flowing through the intake pipe 1 is mixed with the fuel under an emulsion condition, which is sucked out through a main fuel nozzle 10*g* opened into the small venturi 3 arranged in the intake pipe 1, to prepare an air-fuel mixture, which is then fed to the combustion chamber 22. In the prior art carburetor $C_{11}$, moreover, the air-fuel ratio is determined by the flow rate of the fuel which is set by the vacuum pressure in the venturi 3 relative to the flow rate of the intake air, which is set by the opening of the throttle valve 5. The suitable main jet 9 is selected in the fuel passage so as to establish the preset air-fuel ratio. This ratio is liable to fluctuate in dependence upon the running condition of the engine E (e.g., the rpm, load, temperature or the like).

As means for controlling the air-fuel ratio in the prior art carburetor $C_{11}$, therefore, there have been proposed a method for controlling the flow rate of bleed air, in which air is supplied upstream of the main fuel nozzle 10*g* by an air bleed 9*g* and in which additional air is further mixed, and another method for controlling the air-fuel ratio by varying the passage area of the main fuel nozzle 10*g* or the main jet 9.

According to the former method, however, the flow mode is changed into a bubble, slag or piston flow in accordance with the flow rate of the bleed air. These flows will augment the pulsations in the fuel sucked out of the main fuel nozzle 10*g* thereby to invite practical difficulty in responsiveness or controllability. As a result, an intake mixture of proper air-fuel ratio cannot be prepared. If the improper intake mixture is fed to the combustion chamber 22, the engine output fluctuates to induce the vehicular surging phenomena so that the performance and drivability are deteriorated to increase noxious contents in the engine exhaust gases.

According to the latter method, on the other hand, the change in the effective area of the main fuel nozzle 10*g* or the main jet 9 will require markedly precise machining, and it is technically difficult at present to further finely control the diameters relating to the effective area.

The concrete carburetor according to the third aspect of the present invention comtemplates to eliminate the problems concomitant with the prior art and to provide a carburetor which can finely control the fuel flow rate with the use of the jet of a control fluid, which is excellent in responsiveness and stability, which can effect the most proper air-fuel ratio control in accordance with the various running conditions of the engine and which is simple in construction.

Figure 47:
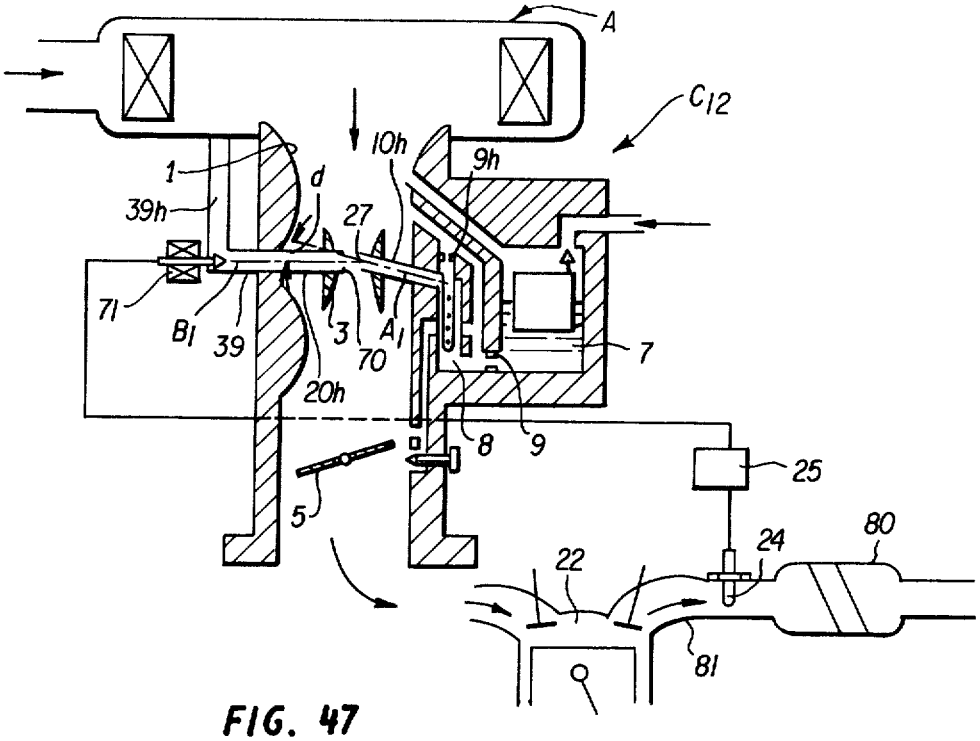
FIGS. 47 and 48 are respectively a longitudinal section and a partially enlarged transverse section showing the jet control carburetor according to an eighth embodiment of the present invention.
Figure 48:
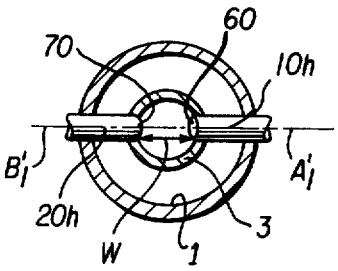

In a carburetor $C_{12}$ according to an eighth embodiment of the third aspect of the present invention, as shown in FIGS. 47 and 48, the intake air flowing through the intake pipe 1 from the air cleaner A is mixed with the fuel, which is sucked into the intake pipe 1 out of the opening 60 of a main fuel nozzle 10*h* opened into the small venturi 3 of a double venturi type, thereby to prepare an intake mixture having a preset air-fuel ratio, which is then fed to the combustion chamber 22. The main fuel nozzle 10*h* communicates with the float chamber 7 at its upstream portion thereof through an air bleed 9*h* and the main jet 9.

In the carburetor $C_{12}$ according to the eighth embodiment, specifically, there are arranged in the small venturi 3 both the opening 60 of the aforementioned main fuel nozzle 10*h* and the injection port 70 of a control air nozzle 20*h* at the outlet side of a control fluid (air) passage 39*h* having substantially the same diameter at a preset spacing W inbetween so that the control fluid can be sucked out.

More specifically, in the carburetor $C_{12}$ of the eighth embodiment, as shown in FIG. 47, the angle between the opening axis $A_1$ of the main fuel nozzle 10*h*, which is inclined upward in the longitudinal direction of the intake pipe 1, and the opening axis $B_1$ of the control air nozzle 20*h*, which is substantially at a right angle with respect to the aforementioned longitudinal direction, is denoted at $\alpha$ and is set at $-12$ degrees. On the other hand, as shown in FIG. 48, the angle between the opening axis $A_1'$ of the main fuel nozzle in the radial direction of the intake pipe 1 and the opening axis $B_1'$ of the control air nozzle 20*h* is denoted at $\theta$ and is set at 0 degrees to have a coaxial relationship.

At a portion, where the opening axes of the main nozzle 10*h* and the control air nozzle 20*h* in the longitudinal direction of the intake pipe 1 partly intersect and partly face each other, the control fluid (air) directly impinges upon the fuel so that the fuel flow rate may be suppressed and controlled by the flow rate of the control fluid. The control air nozzle 20*h* at the outlet side of the control fluid passage 39*h* has its injection port 70 opened into a position downstream of the filter element of the air cleaner A. The control air nozzle 20*h* is equipped with an air-fuel ratio controlling actuator 71 of a throttle means acting as a control valve. This actuator 71 is electrically connected through the controller 25 to the oxygen sensor 24, which is disposed in an exhaust manifold 81, thereby to constitute a closed loop control system. The exhaust manifold 81 is made to have communication with the combustion chamber 22 and has its downstream portion connected to a three-way catalyzer device 80. Thus, the air-fuel ratio of the carburetor $C_{12}$ of the eighth embodiment is controlled to the most proper or stoichiometric value.

In the carburetor $C_{12}$ thus constructed according to the eighth embodiment, the oxygen concentration in the exhaust gases is detected high by the oxygen sensor 24 disposed in the exhaust manifold 81, the output signals relating thereto are fed through the controller 25 to the actuator 71 so that this actuator 71 is operated to block the supply of the control fluid from the control fluid passage 39 toward the opening 60 of the main nozzle 10*h* which has its opening axis intersecting the former. As a result, the intake air and the fuel effect their intrinsic air-fuel ratio control without being adversely affected by the control fluid so that the air-fuel ratio is shifted from a lean side to a rich side thereby to promptly restore the stoichiometric value. On the contrary, if the oxygen concentration in the exhaust gases is low, the relating output signals are fed from the oxygen sensor 24 to the actuator 71 so that this actuator 71 is operated to feed the control fluid from the control air nozzle 20h. As a result, the air-fuel ratio between the intake air and the fuel is shifted from a rich side to a lean side so that it is promptly corrected to the stoichiometric ratio. It has been found that no substantial change take place in the total flow rate of the intake air irrespective of whether the actuator 71 is operating or not. Since, moreover, the control air nozzle 20h is so arranged to face the main fuel nozzle 10h in the small venturi 3 that their opening axes $A_1$ and $B_1$ intersect in the longitudinal direction of the intake pipe 1, it has also been found that no reduction takes place in the fuel sucking ability from the main fuel nozzle 10h into the intake pipe 1. Still moreover, since the carburetor $C_{12}$ of the eighth embodiment does not exert direct change to the emulsion flow in the main fuel nozzle 10h, it can enjoy the practical effect that the intake mixture concentration can be controlled accurately without any disadvantage such as the pulsations in the fuel while enhancing the reliability.

Incidentally, the carburetor $C_{12}$ of the eighth embodiment may also employ a needle valve of the type, which is operative to continuously vary the effective opening area of the actuator 71 so that the ratio in the flow rate between the intake air and the fuel can be suitably set or controlled by controlling the effective opening. Although the carburetor $C_{12}$ of the eighth embodiment is equipped with the air bleed 9h, the present invention should not be limited to such construction but may be effectively practised in the (not-shown) carburetor which is not equipped with the air bleed. According to this modification, the discharge pulsations of the duel due to the air bleed can be completely eliminated to attain the practical effects that the control and operation can be improved and that the construction can be simplified while reducing the production cost.

Figure 49:
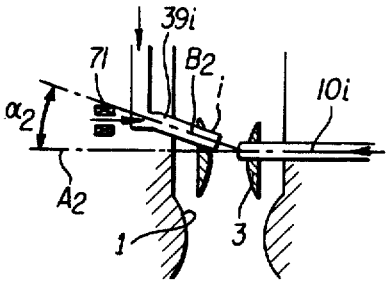
FIG. 49 is a partially schematic view in the longitudinal section showing the jet control carburetor according to a ninth embodiment of the present invention.

Next, the carburetor $C_{13}$ according to a ninth embodiment of the third aspect of the present invention is made different from the aforementioned eighth embodiment, as shown in FIG. 49, in that the angle $\alpha_2$ between the opening axis $B_2$ of a control air nozzle 20i of the control fluid passage 39i, which is inclined downward in the longitudinal direction of the intake pipe 1, and the opening axis $A_2$ of a main fuel nozzle, which is substantially at a right angle with respect to the aforementioned longitudinal direction, is set at 6 degrees.

Figure 50:
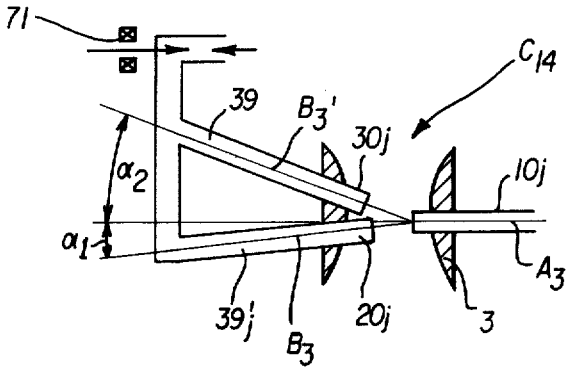
FIG. 50 is a partially schematic view in the longitudinal section showing the jet control carburetor according to a tenth embodiment of the present invention.

On the other hand, a carburetor $C_{14}$ according to a tenth embodiment is made different from the aforementioned respective embodiments, as shown in FIG. 50, in that the angles $\alpha_1$ and $\alpha_2$ between the opening axis $A_3$ of one main fuel nozzle 10j, which is substantially at a right angle with respect to the longitudinal direction of the intake pipe 1, and the opening axes $B_3$ and $B_3'$ of two control air nozzles 20j and 30j of two control fluid passages 39i and 39i', which are oriented upward and downward with respect to the aforementioned longitudinal direction and which are inclined to intersect the aforementioned opening axis $A_3$, are set at $-2$ degrees and 20 degrees. Others are similar to those of the aforementioned eighth embodiment, and the same portions are designated at the same numerals so that their repeated explanations are omitted here.

In the carburetors $C_{13}$ and $C_{14}$ thus constructed according to the ninth and tenth embodiments, the jets of the control fluid, which are discharged in the directions of the opening axes of the main nozzles 10i and 10j from the injection ports of the control air nozzles 20i, 20j and 30j, exert direct impingements upon the flows of the fuel, which are sucked out of the main fuel nozzles 10i and 10j into the small venturi 3 through the openings of the former. In other words, a kind of flow resistance is applied so that the flow rate of the fuel can be reduced more excellently than the case of the aforementioned eighth embodiment.

In the carburetors $C_{13}$ and $C_{14}$ according to the ninth and tenth embodiments, moreover, the fuel discharge during the operation of the actuator 71 can be varied over a wide range by varying the spacing W between the injection ports of the control air nozzles 20i, 20j and 30j and the main fuel nozzles 10i and 10j. As a result, the carburetors $C_{13}$ and $C_{14}$ can enjoy the high practical effect that the fuel discharge can be varied over a remarkably wide range of the air-fuel ratio by selecting the value of the spacing W at a preset size. It is quite natural that the operating effects similar to those of the aforementioned eighth embodiment can also be attained.

Figure 51:
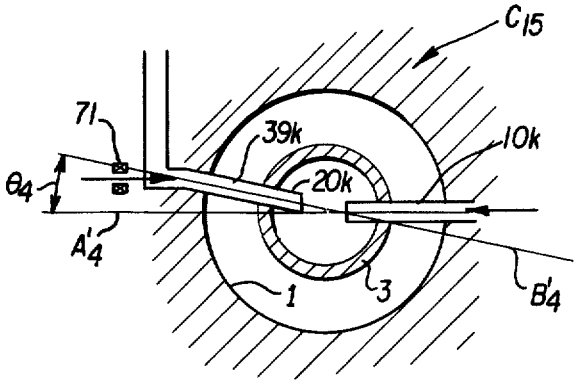
FIG. 51 is a cross-sectional view showing the jet control carburetor according to an eleventh embodiment of the present invention.

Now, a carburetor $C_{15}$ according to an eleventh embodiment of the present invention is made different from the aforementioned respective embodiments, as shown in FIG. 51, in that the angle $\theta_4$ between the opening axis $A_4'$ of a main fuel nozzle 10k in the radial direction of the intake pipe 1 and the opening axis $B_4'$ of a control air nozzle 20k of a control fluid passage 39k is set at 10 degrees and in that the angle $\alpha_4$ between the opening axis $A_4$ of the main fuel nozzle 10k in the longitudinal direction of the intake pipe and the opening axis $B_4$ of the control air nozzle 20k in the aforementioned longitudinal direction (although the two opening axes $A_4$ and $B_4$ are not shown) is set at 0 degrees. In the carburetor $C_{15}$ according to the eleventh embodiment, the opening axes of the main fuel nozzle 10k and the control air nozzle 20k in the radial direction of the intake pipe 1 intersect each other, and the control fluid directly impinges upon the fuel without any fail at the portion, where the nozzle 10k and the nozzle 20k face each other, so that the flow rate of the fuel can be accurately and efficiently controlled by the flow rate of the control fluid. In addition, the operating effects similar to those of the aforementioned respective embodiments can also be attained.

Figure 52:
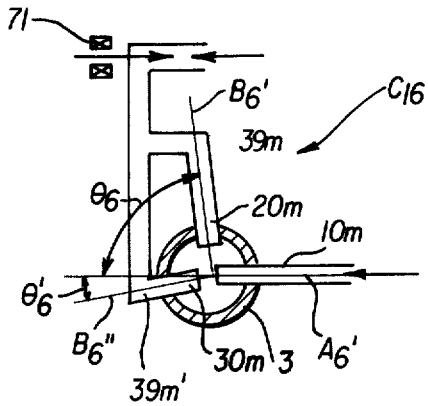
FIG. 52 is a cross-sectional view showing the jet control carburetor according to a twelfth embodiment of the present invention.

Next, a carburetor $C_{16}$ according to a twelfth embodiment is made different from the aforementioned respective embodiments, as shown in FIG. 52, in that the angles $\theta_6$ and $\theta_6'$ between the opening axis $A_6'$ of one main fuel nozzle, which is substantially directed to a right angle with respect to the center axis of the intake pipe 1, and the opening axes $B_6'$ and $B_6''$ of two air nozzles 20m and 30m of two control fluid passages 39m and 39m', which radially protrude at both sides to intersect the aforementioned opening axis $A_6'$, are set at 80 degrees and $-10$ degrees, respectively.

Figure 53:
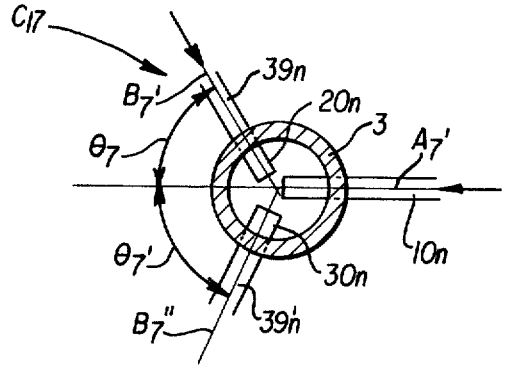
FIG. 53 is a cross-sectional view showing the jet control carburetor according to a thirteenth embodiment of the present invention.
Figure 54:
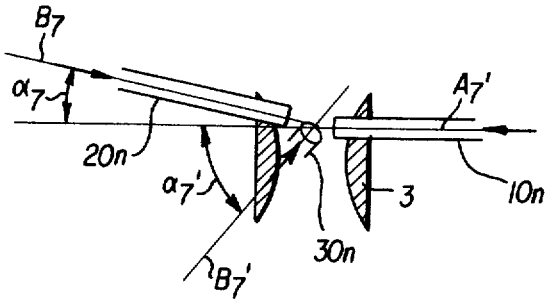
FIG. 54 is a longitudinal-sectional view showing the jet control carburetor according to the thirteenth embodiment of the present invention.

On the other hand, carburetor $C_{17}$ according to thirteenth embodiment is made different from the aforementioned respective embodiments, as shown in FIGS. 53 and 54, in that the angles $\theta_7$ and $\theta_7'$ between the opening axis $A_7'$ of one main fuel nozzle 10n, which is substantially directed to a right angle with respect to the center axis of the intake pipe 1, and the opening axes $B_7'$ and $B_7''$ of two control air nozzle 20n and 30n of two control fluid passages 39n and 39n', which radially protrude at the both sides to intersect the aforementioned opening axis $A_7'$, are set at 60 degrees and $-60$ degrees, respectively, and in that the angles $\alpha_7$ and $\alpha_7'$ between the opening axis $A_7'$ of the main fuel nozzle 10n with respect to the center axis of the intake pipe 1 and the opening axes $B_7$ and $B_7'$ of the respective control air nozzles with respect to the aforementioned center axis thereof are set at 4 degrees and −10 degrees, respectively.

In the carburetors $C_{16}$ and $C_{17}$ thus constructed according to the twelfth and thirteenth embodiments, the opening axes of the main fuel nozzle and the control air nozzles in the radial or longitudinal direction of the intake pipe intersect each other, and the control fluid directly impinge upon the fuel in a proper manner, at a portion, where the main fuel nozzle and the control air nozzle face each other, so that the flow rate of the fuel can be accurately and efficiently controlled by the flow rate of the control fluid. In addition, the operating effects similar to those of the aforementioned respective embodiments can also be attained.

As to the facing arrangements of the main nozzle and the control air nozzles of the carburetors according to the eighth to thirteenth embodiments, by satisfying the relationship (1) and/or the relationship (2):

$$-90 \text{ degrees} < \theta < 90 \text{ degrees; and} \quad (1)$$

$$-90 \text{ degrees} < \alpha < 90 \text{ degrees,} \quad (2)$$

wherein: $\theta$ stands for a predetermined horizontal angle at which the opening axes of the main fuel nozzle and the control air nozzles intersect each other in view of the cross section of the intake pipe: and $\alpha$ stands for a predetermined vertical angle at which the opening axes of the main fuel nozzle and the control air nozzles intersect each other in view of the longitudinal section of the intake pipe, the control fluid is made to directly impinge upon the fuel spurting from the main fuel nozzle so that the flow rate of the fuel can be sufficiently accurately and efficiently controlled by the flow rate of the control fluid. However, in case the two relationships (1) and (2) are not satisfied, the flow rate of the fuel can not be controlled by the flow rate of the control fluid.

Figure 55:
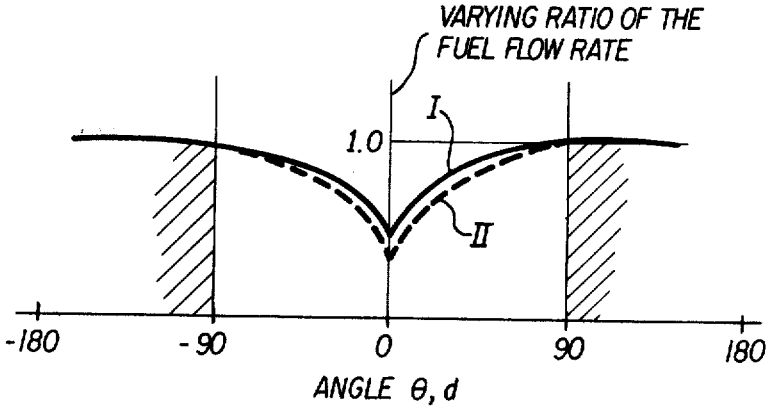
FIG. 55 is a graphical presentation showing the relationship between the varying ratio of the fuel flow rate and a horizontal angle $\theta$ and a vertical angle $\alpha$ of the opening axis of the control air nozzle to the opening axis of the main fuel nozzle.

In the carburetors according to the eighth to thirteenth embodiments, more specifically, the reasons why both the angle predetermined $\alpha$ at which the opening axes of the main fuel nozzle and the control air nozzle in view of the longitudinal section of the intake pipe and the predetermined angle $\theta$ at which the opening axes of the main fuel nozzle and the control air nozzle in view of the cross section of the intake pipe are limited to the aforementioned numeral range are based on several series of experiments and the results of analyses, which have been conducted by the Inventors. As shown in FIG. 55, more specifically, the values of the varying ratios of the fuel flow rate, which are plotted in an ordinate against the aforementioned angles $\theta$ and $\alpha$ in an abscissa, have such tendencies as are shown in solid and broken curves I and II.

By limiting to the aforementioned numerical range, the carburetors of the eighth to thirteenth embodiments can attain such satisfactory varying ratios of the fuel flow rate as are shown in the solid curve I for the construction having one main nozzle and one control air nozzle and such more excellent varying ratios of the fuel flow rate as are shown in the broken curve II for the construction having the main nozzle and at least two control air nozzles. Thus, the carburetors can attain the enhanced practical value of effecting sufficient control of the fuel flow rate with the use of the control fluid. Incidentally, if the carburetor is constructed outside of the aforementioned numerical range, the values of the varying ratios of the fuel flow rate are located in the batched regions in FIG. 55 so that the control of the fuel flow rate cannot be attained by the control fluid.

Therefore, the carburetors thus constructed according to the eighth to thirteenth embodiments of the present invention can attain a number of such practically excellent effects that the air-fuel ratio and the mixing condition between the intake air and the fuel can be stably and highly responsively controlled, that the control fluid can be made to directly impinge upon the fuel without any fail by making the opening axes of the main fuel nozzle and the control air nozzle intersect each other so that the mixing with the intake air and the atomization can be made remarkably fine and satisfactory, that the relating construction, control and operation can be made simple and convenient, and that the reliability and durability can be improved.

Incidentally, the carburetors of the eighth to thirteenth embodiments should not be limited to the constructions thus far described but can be modified such that an air as the control fluid may be introduced from between the venturi and the throttle valve, fed under pressure from a pressurized fluid supply source or from a plenum chamber, or introduced directly from the atmosphere. Moreover, the actuator may be of electromagnetic, hydraulic or pneumatic type or may be practised by an ON-OFF valve, a step motor, a spool valve or a needle valve, and the control of the actuator may be accomplished digitally or analogly and may respond to one of any combination of the operating signals using the acceleration, deceleration, idle, warm-up, altitude, vacuum and start of the engine. On the other hand, not only the oxygen sensor but also one or any combination of temperature, humidity, CO, $CO_2$, HC and $NO_x$ sensors can be employed. Moreover, the carburetor can be exemplified by a carburetor equipped with a single or tripple venturi, a twin carburetor or a variable venturi type carburetor. In any modification, the various practical effects for properly controlling the fuel flow rate can be still retained.

Figure 56:
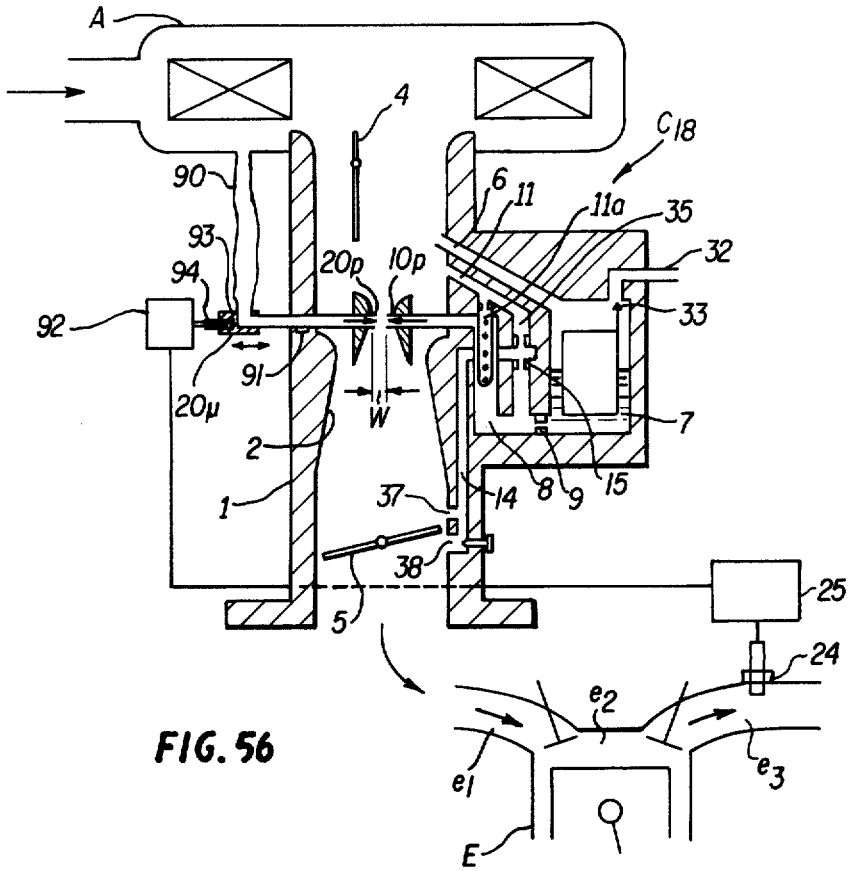
FIG. 56 is a longitudinal-sectional view showing the jet control carburetor according to a fourteenth embodiment of the present invention.

Next, in the carburetor according to a fourteenth embodiment according to the fourth aspect of the present invention, as schematically shown in FIG. 56, the air cleaner A has its outlet connected to the upper end inlet of the intake pipe 1, and the engine E has its intake manifold $e_1$ connected to the lower end outlet of the same. The main or large venturi 2 is disposed at the center portion of the inner circumferential wall of the intake pipe 1. The small venturi 3 has its outlet opened into the throat of the main venturi 2. The choke valve 4 and the throttle valve 5 are disposed upstream and downstream of the small venturi 3 of the intake pipe 1, respectively. The float chamber 7 equipped with the float is disposed sideway of the center portion of the intake pipe 1. The float chamber 7 has its ceiling communicating with the upper portion of the intake pipe 1 through the air vent tube 6. A not-shown fuel pump is connected to the ceiling portion of the float chamber 7 through the fuel tube 32. The needle 33, which is arranged to protrude from the upper side of the float made movable up and down in accordance with the fuel level in the float chamber 7, is disposed to face the fuel outlet of the fuel tube 32 thereby to constitute the needle valve which is operative to maintain the fuel level in the float chamber 7 at a preset level. The inlet of the main fuel passage 8, which is equipped with the jet 9, is connected with the bottom portion of the float chamber 7. The main branch 11*a* of the bleed air passage 11, which is connected to the upper portion of the intake pipe 1, is connected to a midway portion of the main fuel passage 8 through the main air bleed. The main fuel nozzle 10*r* having a circular cross-section, which constitutes the outlet of the main fuel passage 8, is opened to protrude into the diametrical position of the throat of the small venturi 3. The main fuel nozzle 10*r* has its opening arranged at a position higher than the fuel level in the float chamber 7. The slow fuel passage 14 has its inlet connected with the main fuel passage 8 just downstream of the jet 9. The jet 15 is disposed midway of the slow fuel passage 14 which is also arranged at a position higher than the fuel level in the float chamber 7. The slow branch 35 of the bleed air passage 14 is connected to the midway portion of the slow fuel passage 14. The slow port 37 and the idle port 38 both constituting the outlet of the slow fuel passage 14 are opened into the inner circumferential wall of the intake pipe 1 in the vicinity of the throttle valve 5. There are provided the power fuel passage and the acceleration fuel passage, although not shown.

As schematically shown in FIG. 56, an air nozzle 20*r* is connected to the outlet of a control air passage 90 of a flexible tube at the upstream portion thereof, which tube is connected at its inlet to the air filter A downstream of the filter element. The air nozzle 20*r* having a shape of elongated tube is arranged to extend through the circumferential walls of both the intake pipe 1 and the small venturi 3 until its leading end is opened to protrude into the diametrical position of the throat of the small venturi 3. The opening at the leading end of the air nozzle 20*r* is arranged at a position to face the opening of the main fuel nozzle 10*r*. A rotation stopper 91 is applied to the air nozzle 20*r*, which is slidably fitted in the circumferential walls of the intake pipe 1 and the small venturi 3 through a not-shown packing, such that the air nozzle 20*r* can move only in the longitudinal direction thereof thereby to increase and decrease the spacing between the openings of the air nozzle 20*r* and the main fuel nozzle 10*r*, which are coaxially arranged. At the midway portion of the control air passage 90 protruding out of the intake pipe 2, there is disposed a step motor 92 which can rotate back and forth with about 1000 steps persecond. A threaded shaft 94, which is connected to the shaft of the step motor 92 is screwed in the threaded hole of a threaded cylinder 93, which is fixed to the control air passage connected to the air nozzle 20*r*, so that the air nozzle 20*r* may be moved back and forth in its longitudinal direction by the forward and backward rotations of the step motor 92 to increase and decrease the spacing W between the air nozzle 20*r* and the main fuel nozzle 10*r* at the openings thereof. The engine E has its exhaust manifold $e_3$ equipped with the oxygen sensor 24, which is operative to generate a voltage in accordance with the oxygen concentration in the exhaust gases. When the oxygen concentration in the exhaust gases of the engine E is higher than a reference value so that the output voltage of the oxygen sensor 24 is lower than a reference value, the step motor 92 is reversed. On the contrary, when the oxygen concentration in the exhaust gases is lower than the reference value so that the output voltage of the oxygen sensor 24 is higher than the reference value, the step motor 92 is turned forward. These controls of the step motors 92 are accomplished by the control circuit 25. Thus, the air nozzle drive control device is constructed of the mechanisms 93 and 94 for converting the rotations into the linear movements, the step motor 92, the control circuit 25 and the oxygen sensor 24. On the other hand, the closed loop control system is constructed of the main nozzle 10*r*, the intake pipe 1, the intake manifold $e_1$, the combustion chamber $e_2$ and the exhaust manifold $e_3$ of the engine E, the air nozzle drive control device 93, 94, 92, 25 and 27, and the air nozzle 20*r* connected with the control air passage 90.

Figure 57:
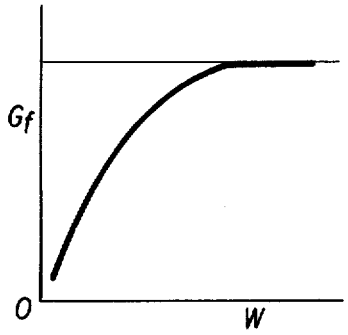
FIG. 57 is a graphical presentation showing the relationship between the fuel flow rate $G_f$ and the spacing W between the main fuel nozzle and a control air nozzle.

In the operation of the carburetor $C_{18}$ according to the present embodiment, air is sucked into the intake pipe 1 through the air cleaner A by the rotational drive of the engine E. During the high speed running operations of the engine E with the throttle valve 5 being fully open, the fuel under an emulsion condition is sucked from the main fuel nozzle 10*r* by the vacuum pressure in the small venturi 3. As a result, a mixture is prepared with the fuel, which is sucked under the emulsion condition into the intake pipe 1, and with the intake air flowing through the intake pipe. The mixture thus prepared is fed to the combustion chamber $e_2$ of the engine E. At this instant, the control air is sucked by the vacuum pressure in the small venturi 3 from the air nozzle 20*r* which is connected through the control air passage 90 with the air filter A downstream of the filter element. The air thus sucked from the air nozzle 20*r* impinges upon the fuel sucked from the main nozzle so that the force for injecting the fuel from the main nozzle 10*r* is weakened to reduce the flow rate of the fuel from the main nozzle 10*r*. And, this flow rate $G_f$ of the fuel from the main fuel nozzle 10*r* is varied, as shown in FIG. 57, in accordance with the spacing W between the openings of the main fuel nozzle 10*r* and the air nozzle 20*r*. If the nozzle spacing W is increased, the impinging force of the air from the air nozzle 20*r* is weakened to inversely proportionately increase the fuel flow rate $G_f$ so that the air-fuel ratio of the intake mixture is reduced. On the contrary, if the nozzle spacing W is decreased, the impinging force of the air from the air nozzle 20*r* is strengthened to inversely proportionately decrease the fuel flow rate $G_f$ so that the air-fuel ratio of the intake mixture is increased. In the carburetor $C_{18}$ according to the present embodiment, therefore, if the output voltage of the oxygen sensor 24 is lower than the reference value so that the oxygen concentration in the exhaust gases of the engine E is higher than the reference value, i.e., so that the air-fuel ratio of the intake mixture to be supplied to the engine is higher than a proper value (a lean mixture condition), the control unit 25 reverses the step motor 92 to retract the air nozzle 20*r* thereby to enlarge the spacing W between the openings of the air nozzle 20*r* and the main fuel nozzle 10*r* so that the flow rate of the fuel spurting from the main fuel nozzle is augmented to reduce the air-fuel ratio of the intake mixture to the proper value. If, on the contrary, the oxygen concentration in the exhaust gases of the engine E is lower than the reference value, the control unit 25 turns forward the step motor 92 to shorten the spacing W between the openings of the air nozzle 20*r* and the main fuel nozzle 10*r* so that the flow rate of the fuel spurting from the main nozzle 10*r* is reduced to enlarge the air-fuel ratio of the intake mixture to the proper value. Thus, the air-fuel ratio of the intake mixture to be fed to the engine can be controlled to the proper value in accordance with the oxygen concentration in the exhaust gases in the engine E.

In the carburetor $C_{18}$ according to the present fourteenth embodiment, when it is intended to control the flow rate of the fuel spurting from the main nozzle, the spacing between the openings of the main fuel nozzle and the air nozzle is varied while keeping the flow rate of the air from the air nozzle invaried. As compared with the case, in which the flow rate of the air injected from the air nozzle is varied by the ON-OFF, analog or digital control, less disturbances are invited in the intake air flow in the intake pipe due to the air flow injected from the air nozzle, and the fuel spurting from the main nozzle can be held under better atomized and distributed conditions.

The carburetor $C_{18}$ according to the present fourteenth embodiment has been schematically shown in FIGS. 56 and 57 and described in the above but can be modified, as will be exemplified in the following.

(1) The control unit 25 for turning the step motor 92 back and forth while the output voltage of the oxygen sensor 24 is lower or higher than the reference value is replaced by a control circuit for turning the step motor 92 back and forth each short time interval for the steps of the number corresponding to the quantity, in which the output voltage of the oxygen sensor 24 is different from the reference value.

(2) The step motor 92 and the rotation covering mechanisms 93 and 94 are replaced by a linear motor, and the control circuit 25 for turning the step motor back and forth is replaced either by a linear motor control circuit for retracting the linear motor, when the output voltage of the oxygen sensor 24 is lower than the reference value, so that the air nozzle **20*r* carried on the movable member of the linear motor may be retracted and for driving the linear motor forward, when the output voltage of the oxygen sensor 24 is higher than the reference value, so that the air nozzle 20*r*** may be moved forward, or by a linear motor control circuit for driving the linear motor forward and backward each short time interval by the distance corresponding to the quantity, in which the output voltage of the oxygen sensor is different from the reference value.

(3) There are used either an air nozzle drive control device for shifting the position of the air nozzle **20*r* such that the spacing W between the openings of the air nozzle 20*r* and the main fuel nozzle 10*r* takes a distance corresponding to the level of the output voltage of the oxygen sensor or an air nozzle drive control device for moving the air nozzle 20*r* back and forth for a preset cycle so that the time period for each cycle, during which the air nozzle 20*r* is halted at the leading or trailing end of its stroke, is increased and decreased in accordance with the level of the output voltage of the oxygen sensor 24**.

(4) As means for detecting the running condition of the engine E, there are used not only the oxygen sensor 24 but also a CO, $CO_2$, HC or $NO_x$ sensor, or a temperature or humidity sensor. In another modification, those sensors are used solely or in suitable combination.

(5) The inlet of the control air passage 90 is not connected to the air filter A downstream of the filter element but is directly vented to the atmosphere. In another modification, an air pump is connected to the inlet of the control air passage 90 thereby to pump air thereinto.

(6) One or both of the air bleed mechanism **11*a* and 35, which are disposed in the main fuel passage 8 and in the slow fuel passage 14**, are removed. Then, it is possible to obviate the pulsations in the fuel flow due to the existence of the air bleed or bleeds and accordingly the fluctuations in the air-fuel ratio of the intake mixture.

(7) The venturi 2 and 3 of the carburetor are replaced by single or tripple venturi or by a variable venturi. And, the carburetor itself is replaced by a twin carburetor.

Although only representatives of the present invention have been described hereinbefore in connection with the embodiments and modifications, the present invention should not be limited thereto but can be so further modified to allow the embodiments to interchange their components or parts.

Obviously, numerous modifications and variations of the present invention are possible in light of the above teachings. It is therefore to be understood that within the scope of the appended claims, the invention may be practiced otherwise than as specifically described herein.

What is claimed is:

1. A jet control type carburetor comprising:

an intake pipe having an intake passage formed in an inner wall thereof, said intake passage allowing an intake air to flow therethrough;

a venturi provided in said intake pipe, for increasing flow velocity of said intake air in said intake passage to reduce the pressure thereof;

a fuel nozzle opened into said intake passage and connected to a fuel supply source through a fuel passage for supplying the fuel into said intake passage from said fuel nozzle in order to introduce the mixture of air and fuel into said intake passage;

a throttle valve provided downstream of said venturi, for controlling the flow rate of said mixture of intake air and fuel;

a control air nozzle opened into said intake passage at a point upstream from said throttle valve, said point including the position of said throttle valve, said nozzle being connected to an air supply source through a control air passage for directly jetting the flow of said control air to the fuel spurted from said fuel nozzle to afford a predetermined velocity component of said control air having a directional sense contrary to that of the spurted fuel, thereby to cause said control air to impinge upon said fuel spurted from said fuel nozzle and to restrain the fuel flow rate from said fuel nozzle, and a throttle means provided upstream of said control air nozzle in said control air passage, for controlling the flow rate of said control air in accordance with a driving condition of said engine;

said control air nozzle having a predetermined inner diameter ($d_a$), being provided at a portion spacing apart from said fuel nozzle with a predetermined distance (W), and a dimensional relationship of the spacing W between said fuel nozzle and said control air nozzle to the inner diameter $d_a$ of said control air nozzle being set as follows:

$$W/d_a \leqq 20.$$

whereby the control air injected from said control air nozzle has enough flow rate and flow velocity to obtain its desired impinging force, penetrates the flow of the intake air and reaches the flow of the fuel spurted from the fuel nozzle, so that the flow rate of the fuel and the air-fuel ratio of the intake mixture are accurately controlled over a wide range of the driving conditions of said engine.

2. A jet control carburetor according to claim 1, wherein said fuel nozzle has a predetermined inner diameter ($d_f$), and a dimensional relationship of the inner diameters $d_a$ and $d_f$ of said control air nozzle and said fuel nozzle is set as follows:

$$d_a/d_f \geqq 0.1$$

3. A jet control carburetor according to claim 2, wherein said control air nozzle is provided at said venturi, a main fuel nozzle of said fuel nozzle is opened within said venturi, and is projected from an inner wall of said venturi with a predetermined length (x), said venturi has a throttled part with a predetermined inner diameter (d), and a dimensional relationship between the projecting length x of said main fuel nozzle and the inner diameter d of said venturi is set as follows;

$$0.3 \leqq x/d \leqq 0.8$$

4. A jet control carburetor according to claim 2, wherein at least one control air nozzle and a main fuel nozzle of said fuel nozzle are arranged to have the axes of their respective openings intersecting with a predetermined angle, and the horizontal angle relation of the opening axis of said main fuel nozzle and the opening axis of said control air nozzle is determined at an angle ($\theta$) in view of the cross section of said intake passage, and the vertical angle relation of the opening axis of said main fuel nozzle and the opening axis of said control air nozzle is determined at an angle ($\alpha$) in view of the longitudinal section of said intake passage, the relationships of the horizontal angle $\theta$ and the vertical angle are set as follows;

$$-90° \leqq \theta \leqq 90°$$

$$-90° \leqq \alpha \leqq 90°$$

whereby the jet of the control air penetrates the flow of the intake air and effectively reaches the spurted fuel, and the flow rate of the fuel is accurately controlled.

5. A jet control carburetor according to claim 2, further comprising a driving control device, connected to said control air nozzle, for moving said control air nozzle in the axial direction thereof in accordance with the running condition of an engine and for varying the spacing W between the openings of said control air nozzle and said fuel nozzle, whereby the control air injected from said control air nozzle is made to impinge upon the fuel spurting from the main fuel nozzle, and the spacing W between the openings of the control air and fuel nozzles is varied in accordance with the running condition of the engine, and the flow rate of the fuel spurting from the main fuel nozzle is controlled by the change in the impinging force of the control air from said control air nozzle.

6. A jet control carburetor according to claim 2, wherein said control air nozzle is disposed at a portion under the low pressure in said intake passage, and said control air passage is connected to a portion under the high pressure in said intake passage, thereby jetting the flow of said control air to the fuel spurted from said fuel nozzle by utilizing the pressure difference in said intake passage.

7. A jet control carburetor according to claim 2, wherein said control air supply source supplies the control air having a predetermined pressure, thereby jetting the flow of said pressurized control air to the fuel spurting from said fuel nozzle.

8. A jet control carburetor according to claim 6, wherein said dimensional relationship of the spacing W between said fuel nozzle and said control air nozzle to the inner diameter $d_a$ of said control air nozzle, and said dimensional relationship of said inner diameter $d_a$ of said control air nozzle to the inner diameter $d_f$ of said fuel nozzle are set as follows:

$$W/d_a \leqq 10$$

$$d_a/d_f \geqq 0.2$$

9. A jet control carburetor according to claim 7, wherein said dimensional relationship of the spacing W between said fuel nozzle and said control air nozzle to the inner diameter $d_a$ of said control air nozzle, and said dimensional relationship of said inner diameter $d_a$ of said control air nozzle to the inner diameter $d_f$ of said fuel nozzle are set as follows:

$$W/d_a \leqq 15$$

$$d_a/d_f \geqq 0.17$$

10. A jet control carburetor according to claim 8, wherein said control air nozzle and fuel nozzle are projected from an inner wall of said venturi said control air nozzle is opposed to said fuel nozzle, and said dimensional relationship of the spacing W between said fuel nozzle and said control air nozzle to the inner diameter $d_a$ of said control air nozzle, and said dimensional relationship of said inner diameter $d_a$ of said control air nozzle to the inner diameter $d_f$ of said fuel nozzle are set as follows:

$$W/d_a \leqq 2$$

$$d_a/d_f \geqq 0.2.$$

11. A jet control carburetor according to claim 10, wherein said dimensional relationship of the spacing W between said fuel nozzle and said control air nozzle to the inner diameter $d_a$ of said control air nozzle, and said dimensional relationship of said inner diameter $d_a$ of said control air nozzle to the inner diameter $d_f$ of said fuel nozzle are set as follows:

$$W/d_a \leqq 2$$

$$1.2 \geqq d_a/d_f \geqq 0.2.$$

12. A jet control carburetor according to claim 11, wherein said dimensional relationship of the spacing W between said fuel nozzle and said control air nozzle to the inner diameter $d_a$ of said control air nozzle is set as follows:

$W/d_a \leqq 6$.

13. A jet control carburetor according to claim 8, further comprising a distribution bar having a circular cross section for penetrating through said venturi, said control air nozzle and said fuel nozzle being opposedly provided below said distribution bar for promoting the mixing of the fuel and intake air to control the impinging force of the control air spurting from the control air nozzle for changing the flow rate of the fuel from the main fuel nozzle thereby to control the air-fuel ratio of the intake mixture, and dimensional relationships of the spacing W between said fuel nozzle and said control air nozzle to the inner diameter $d_a$ of said control air nozzle, and of said inner diameter $d_a$ of said control air nozzle to the inner diameter $d_f$ of said fuel nozzle being set respectively as follows:

$W/d_a \leqq 10$ $d_a/d_f \geqq 0.2$

14. A jet control carburetor according to claim 13, wherein said dimensional relationships of the spacing W between said fuel nozzle and said control air nozzle to the inner diameter $d_a$ of said control air nozzle, and said dimensional relationship of said inner diameter $d_a$ of said control air nozzle to the diameter $d_f$ of said fuel nozzle are set as follows:

$W/d_a \leqq 5$ $2.0 \geqq d_a/d_f \geqq 0.2$.

15. A jet control carburetor according to claim 14, wherein said dimensional relationship of the spacing W between said fuel nozzle and said control air nozzle to the inner diameter $d_a$ of said control air nozzle is set as follows:

$W/d_a \leqq 1.5$

16. A jet control carburetor according to claim 14, wherein said dimensional relationship of the inner diameter $d_a$ of said control air nozzle, and fuel nozzle to the inner diameter $d_f$ of said fuel nozzle is set as follows:

$d_a/d_f \geqq 1$

17. A jet control carburetor according to claim 14, wherein said control air nozzle is positioned at a portion spaced from the main fuel nozzle by a predetermined distance($e_l$) along the axial direction of said venturi, control air nozzle is positioned at a portion spaced from the main fuel nozzle by a predetermined distance($e_r$) along the radial direction of said venturi, said dimensional relationship of the spacing W between said fuel nozzle and said control air nozzle to the inner diameter $d_a$ of said control air nozzle is set as follows:

$W/d_a \leqq 2$ said dimensional relationship of the inner diameters $d_a$ and $d_f$ of said control air nozzle and said fuel nozzle is set as follows:

$2.0 \geqq d_a/d_f \geqq 0.2$ a dimensional relationship of the axial distance $e_l$ to the inner diameter $d_a$ of said control air nozzle is set as follows:

$1.5 \leqq e_l/d_a \leqq 2.5$, and a dimensional relationship of the radial distance $e_r$ to the inner diameter $d_a$ of said control air nozzle is set as follows:

$e_r/d_a \leqq 1.5$

18. A jet control carburetor according to claim 9, wherein said control air nozzle and fuel nozzle are projected from an inner wall of said venturi, said control air nozzle is opposed to said fuel nozzle, and dimensional relationships of the spacing W between said fuel nozzle and said control air nozzle to the inner diameter $d_a$ of said control air nozzle, and said diameter $d_a$ of said control air nozzle to the inner diameter $d_f$ of said fuel nozzle are set respectively as follows:

$W/d_a \leqq 3$ $d_a/d_f \geqq 0.3$

19. A jet control carburetor according to claim 9, further comprising a distribution bar having a circular cross section for penetrating through said venturi, said control air nozzle and said fuel nozzle being opposedly provided below said distribution bar for promoting the mixing of the fuel and intake air to control the impinging force of the control air spurting from the control air nozzle for changing the flow rate of the fuel from the main fuel nozzle thereby to control the air-fuel ratio of the intake mixture, and dimensional relationships of the spacing W between said fuel nozzle and said control air nozzle, and said inner diameter $d_a$ of said control air nozzle and said fuel nozzle to the inner diameter $d_f$ of said fuel nozzle being set as follows:

$0.2 \leqq W/d_a \leqq 7.5$ $d_a/d_f \leqq 3$

20. A jet control carburetor according to claim 17, wherein said control air nozzle is positioned at a portion spaced from the main fuel nozzle by a predetermined distance ($e_l$) along the axial direction of said venturi, control air nozzle is positioned at a portion apart from the main fuel nozzle by a predetermined distance ($e_r$) along the radial direction of said venturi, said dimensional relationship of the spacing W between said fuel nozzle and said control air nozzle to the inner diameter $d_a$ of said control air nozzle is set as follows:

$W/d_a \leqq 3$, said dimensional relationship of the inner diameters $d_a$ and $d_f$ of said control air nozzle and said fuel nozzle is set as follows:

$$3 \geqq d_a/d_f \geqq 0.17$$

a dimensional relationship of the axial distance $e_l$ to the inner diameter $d_a$ of said control air nozzle is set as follows:

$$1.5 \leqq e_l/d_a \leqq 2.5, \text{ and}$$

a dimensional relationship of the radial distance $e_r$ to the inner diameter $d_a$ of said control air nozzle is set as follows:

$$e_r/d_a \leqq 1.5.$$

21. A jet control carburetor according to claim 3, wherein said control air nozzle is projected from said inner wall of said venturi, and said dimensional relationship of the length x of protrusion of said main fuel nozzle into said venturi and said venturi to the inner diameter d of said venturi is set as follows:

$$0.55 \leqq x/d \leqq 0.65$$

22. A jet control carburetor according to claim 21, further comprising a distribution bar having a circular cross section for penetrating through said venturi, said control air nozzle and said fuel nozzle being opposedly provided below said distribution bar for promoting the mixing of the fuel and intake air to control the impinging force of the control air spurting from the control air nozzle for changing the flow rate of the fuel from the main nozzle thereby to control the air-fuel ratio of the intake mixture.

23. A jet control carburetor according to claim 21, wherein said fuel nozzle comprises a tube means penetrating through said venturi and having a notched opening at a side wall thereof, and said control air nozzle is connected with said tube means, thereby jetting the control air from said control air nozzle to the fuel within said tube means and spurting the control fluid and the fuel into said intake passage from said notched opening of said tube means.

24. A jet control carburetor according to claim 21, wherein said dimensional relationship of the length x of protrusion of said main fuel nozzle to the inner diameter d of said venturi is set as follows:

$$x/d \approx 0.6$$

25. A jet control carburetor according to claim 4, wherein the horizontal angle $\theta$ is 0° and the vertical angle $\alpha$ is −12°.

26. A jet control carburetor according to claim 4, wherein the horizontal angle $\theta$ is 0° and the vertical angle $\alpha$ is 6°.

27. A jet control carburetor according to claim 4, wherein the horizontal angle $\theta$ is 10°, and the vertical angle $\alpha$ is 0°.

28. A jet control carburetor according to claim 4, wherein the horizontal angle $\theta_1$ of a first control air nozzle is 80°, and the horizontal angle $\theta_2$ of a second control air nozzle is −10°.

29. A jet control carburetor according to claim 4, wherein the horizontal angle $\theta$ is 0°, and the vertical angles $\alpha_1$ and $\alpha_2$ of a first and second air nozzles are −2° and 20°, respectively.

30. A jet control carburetor according to claim 4, wherein the horizontal angles $\theta_1$ and $\theta_2$ of first and second control air nozzles are −60° and 60°, respectively; and the vertical angles $\alpha_1$ and $\alpha_2$ of first and second control air nozzles are 4° and −10°, respectively.

31. A jet control carburetor according to claim 5, wherein said driving control device comprises a step motor which can rotate back and forth with predetermined steps and has a rotation shaft of said step motor in engagement with said control air nozzle, and a controller connected to an oxygen sensor inserted within an exhaust passage of an engine and to said step motor, for controlling said step motor, thereby moving said control air nozzle in the axial direction thereof.

* * * * *